US010354822B2

(12) United States Patent
Fiederer et al.

(10) Patent No.: US 10,354,822 B2
(45) Date of Patent: Jul. 16, 2019

(54) ELECTRICAL SWITCH, IN PARTICULAR A SWITCH FOR AN ELECTRICAL POWER TOOL

(71) Applicant: MARQUARDT VERWALTUNGS-GMBH, Rietheim-Weilheim (DE)

(72) Inventors: Klaus Fiederer, Duerbheim (DE); Daniel Hafen, Villingen-Schwenningen (DE); Frank Baumgaertner, Stockach (DE); Frank Hacke, Steisslingen (DE); Alexander Ruf, Singen (DE); Clemens Lauer, Kuernbach (DE)

(73) Assignee: Marquardt Verwaltungs-GmbH, Rietheim-Weilheim (DE)

( * ) Notice: Subject to any disclaimer, the term of this patent is extended or adjusted under 35 U.S.C. 154(b) by 209 days.

(21) Appl. No.: 15/098,731

(22) Filed: Apr. 14, 2016

(65) Prior Publication Data

US 2016/0293369 A1 Oct. 6, 2016

Related U.S. Application Data

(63) Continuation of application No. PCT/EP2014/072650, filed on Oct. 22, 2014.

(30) Foreign Application Priority Data

Oct. 22, 2013 (DE) ..... 10 2013 017 440

(51) Int. Cl.
*H01H 83/12* (2006.01)
*H01H 50/64* (2006.01)
(Continued)

(52) U.S. Cl.
CPC ..... *H01H 50/64* (2013.01); *H01H 50/18* (2013.01); *H01H 83/12* (2013.01); *H01H 3/54* (2013.01);
(Continued)

(58) Field of Classification Search
CPC ..... H01H 83/12; H01H 2231/048
See application file for complete search history.

(56) References Cited

U.S. PATENT DOCUMENTS 5,184,101 A 2/1993 Ineichen et al.
5,525,948 A 6/1996 Poulsen
5,651,452 A 7/1997 Schaeffeler et al.

FOREIGN PATENT DOCUMENTS

CN 2531512 Y 1/2003
CN 101882523 A 11/2010
(Continued)

OTHER PUBLICATIONS

Chinese Supplementary Search Report (Application No. 2014800698064) dated Apr. 17, 2018.
(Continued)

*Primary Examiner* — Ramon M Barrera
(74) *Attorney, Agent, or Firm* — Burr & Brown, PLLC

(57) ABSTRACT

An electrical switch for an electric power tool. The electrical switch has a contact system that can be switched between an off position and an on position, and having a movable actuating means or switching the contact system. The actuating means comprises a plunger and a contact piece. The contact piece acts on the contact system for the purpose of switching. A coupling element is provided, such that the plunger can be brought into and out of interaction with the contact piece. The interaction is effected such that it is made possible for the contact system to be switched into the on position and the off position by means of the plunger, and for the contact system to be switched into the off position independently of the plunger.

16 Claims, 30 Drawing Sheets

(51) Int. Cl.

| | |
|---|---|
| ***H01H 50/18*** | (2006.01) |
| *H01H 3/54* | (2006.01) |
| *H01H 9/06* | (2006.01) |

(52) U.S. Cl.

CPC ..... *H01H 9/06* (2013.01); *H01H 2231/048* (2013.01); *H01H 2235/01* (2013.01)

(56) References Cited

FOREIGN PATENT DOCUMENTS

| | | | |
|---|---|---|---|
| CN | 102097224 | A | 6/2011 |
| DE | 857 415 | B | 11/1952 |
| DE | 26 26 003 | A1 | 12/1977 |
| DE | 28 00 041 | A1 | 7/1979 |
| DE | 44 37 020 | A1 | 4/1996 |
| EP | 0 174 382 | A1 | 3/1986 |
| EP | 0 458 190 | A1 | 11/1991 |
| EP | 1 001 505 | A2 | 5/2000 |
| EP | 1 168 390 | A1 | 1/2002 |
| EP | 1 818 962 | A2 | 8/2007 |
| JP | 07-320586 | A1 | 12/1995 |
| WO | 86/01936 | A1 | 3/1986 |

OTHER PUBLICATIONS

International Preliminary Report on Patentability (PCT/EP2014/072650) dated May 6, 2016.

German Search Report (Application No. 10 2013 017 440.6) dated Mar. 31, 2014.

International Search Report and Written Opinion (Application No. PCT/EP2014/072650) dated Jan. 28, 2015.

Chinese Office Action (with English translation), Chinese Application No. 201480069806.4, dated Jun. 22, 2017 (11 pages).

Chinese Office Action (Application No. 201480069806.4) dated Oct. 15, 2018 (in English).

ELECTRICAL SWITCH, IN PARTICULAR A SWITCH FOR AN ELECTRICAL POWER TOOL

FIELD OF THE INVENTION

The invention relates to an electrical switch.

BACKGROUND OF THE INVENTION

The principal use of such electrical switches is for an electric power tool. These electric power tools may be angle grinders, power drills, sanders, saws, planes or the like.

Known from DE 44 37 020 A1 is an electrical switch having a contact system that can be switched between an off position and an on position. The switch additionally has a movable actuating means for switching the contact system. It has been found that, in the case of failure and subsequent restoration of the voltage supply, a switched-on electric power tool in which such a switch is used may start up again in an unintended manner and/or when unattended. This may result in hazardous situations for the user of the electric power tool. In particular, there is the risk of such a re-start if the electric power tool is provided with a device for locking the actuating means in the on position of the contact system.

SUMMARY OF THE INVENTION

The present invention is based on the object of further developing the switch in such a manner that a restart protection for the electric power tool is provided on the switch and, in particular, with the switch being of a simple design.

In the case of the switch according to the present invention, the actuating means comprises a plunger and a contact piece, the contact piece acting on the contact system for the purpose of switching. Furthermore, a coupling element is provided, such that the plunger can be brought into and/or out of interaction with the contact piece. In particular, this interaction is effected such that it is made possible for the contact system to be switched into at least one position by means of the plunger and for the contact system to be switched into at least one position independently of the plunger. Expediently in this case, it can be made possible for the contact system to be switched into the on position and the off position by means of the plunger, and for the contact system to be switched into the off position independently of the plunger.

In a further design, at least one elastic element may act on the actuating means for the purpose of resetting the latter to the off position of the contact system. For this purpose, it may be appropriate, simply, for a compression spring to act on the contact piece.

For the purpose of a compact design, the coupling element may be disposed in a movable manner on the contact piece. In particular, for reasons of simplicity it may be appropriate for the coupling element to be mounted in a rotatable manner on the contact piece.

In a compact design, an actuator may be provided for moving and/or holding the coupling element, such that, in a first position of the coupling element (namely, coupled position), the plunger is in interaction with the contact piece and, in a second position of the coupling element (namely, decoupled position), the plunger is out of interaction with the contact piece. Furthermore, it may be appropriate for the coupling element to be held in the first position by an elastic means, which may simply be a compression spring.

For reasons of simplicity, a transmission element may be provided between the coupling element and the actuator for moving and/or holding the coupling element. The transmission element may be realized, in a compact manner, in the manner of a slide, a fork element or the like. Furthermore, it may be appropriate for the transmission element to move the coupling element into the second position by means of an elastic element, in particular by means of a compression spring.

The actuator may be an electromagnet, since such a design operates in a particularly functionally safe and reliable manner. In a compact design, the electromagnet may be realized as a holding magnet that, when receiving voltage, holds the transmission element in place, and/or as a stroke magnet that, when receiving voltage, releases the transmission element.

In a development of particularly simple design, the coupling element may consist of a rotary disk, rotary pin, rotary lever or the like. In a simple and compact manner, a coupling region may be provided, in the manner of a gate element on the plunger and/or on the coupling element. The coupling element can thereby be moved into the second position in the case of resetting of the plunger that is out of interaction with the contact piece.

At least one electrical connection, for supplying the voltage to the contact system, may be provided on the electrical switch. For simplicity of functionality, this supplied voltage may likewise be received by the electromagnet. Finally, at least one further electrical connection may be provided, for taking off the voltage switched by means of the contact system.

For a particularly preferred design, the following is to be noted. Created is a switch, in particular for small angle grinders having integrated restart protection. For this switch, the following is to be ensured:

- Switch of compact design with indirect actuation for small angle grinders having integrated restart protection. According to the amended appliance standard EN 60745-2-3, the restart protection function will also be required in future, from 2016 onwards, for small angle grinders.
- The restart protection prevents an appliance, when locked in the ON position, from starting up again in an unintended manner and/or when unattended following failure and restoration of the mains electric power supply, and thus from being able to create hazardous situations for the user.
- The restart protection function is already being realized at present by various separate electronic modules in small angle grinders that also have other integrated electronic features, such as overload protection, speed preselection, etc. The present invention, however, is aimed at those appliances that at present do not comprise any electronics, but that in the future will also have to comply with the requirement of the standard. Ideally, this then requires only the replacement of the switch for the appliance to comply with the restart protection requirement of the standard.
- In the case of small angle grinders, locking is usually realized on the external actuating element of the appliance. In general, a distinction is made between slide actuation and paddle actuation. The present solution is intended to be suitable for both commonly used types of actuation. In the case of slide actuation, a tilt movement, for example, brings the actuating element of the slide into the locking position. In the case of paddle actuation, this is effected, for example, by a separate locking knob. In order to reach the widest possible market with the solution according to the invention, the latter is to be implemented without the need for the manufacturer of the electric power tool to alter the actuating and/or locking system.

Since it is only with difficulty that a solution integrated in the switch can access the external actuating and/or locking system, following failure and restoration of the voltage supply the restart protection in the switch must interrupt, or prevent, the flow of current despite the external actuating system remaining locked in the ON position, and the switch plunger (actuator) therefore also continuing to be held in the ON position.

The other functions of the switch are to be maintained.

In the case of the switch, the actuator of the switch is divided into the elements "plunger" and "contact piece". The plunger transmits the movement of the external actuator of the electric power tool, i.e. of the paddle or slide, into the interior of the switch. The contact piece transmits this movement the mechanical contact system and causes the contacts to close and/or open. Both elements, i.e. the plunger and the contact piece, are pushed into the OFF position by compression springs. These two elements are mechanically coupled by a rotary disk. The rotary disk has two rotary positions, "coupled" and "decoupled". The coupling is effected, for example, via a corresponding gate element on the outer wall of the plunger and on the inner wall of the disk. In the "coupled" position, the contact piece is driven by the plunger when the plunger is pressed into the ON position from outside. In the "decoupled" position, the contact piece is not driven by the plunger or, when the switch is in the ON position and the rotary disk is then brought into the "decoupled" position, the contact piece moves into the OFF position, while the plunger can remain in the ON position. This means that:

When the disk is in the "coupled" position, switching on and/or off can be effected in the normal manner by actuation of the plunger.

When the disk is in the "decoupled" position, although the plunger can be actuated in the normal manner the contact piece nevertheless does not come into the ON position, but remains in the "OFF" position.

If "coupled" switch-on is first effected and the disk is then brought into the "decoupled" position, the contact piece springs into the OFF position. A new coupling between the plunger and contact piece is effected only if both parts, i.e. the plunger and the contact piece, are in the OFF position and the disk is in the "coupled" position.

Guiding of the rotary disk is effected via an electromagnet. If the electromagnet is realized as a stroke magnet, upon application of a voltage the stroke magnet pulls in its armature against the force of a restoring spring and, via a mechanical coupling of the armature to the rotary disk, brings the latter into the "coupled" position. If the voltage supply to the stroke magnet is interrupted, the force of the armature restoring spring causes the armature to be returned to its initial position, and the disk returns to the "decoupled" position.

The electromagnet is preferably electrically connected such that it is fed with current as soon as mains supply voltage is applied to the mains supply inputs of the switch, i.e. as soon as the mains supply plug of the device is inserted. Alternatively, this may also be effected via an auxiliary contact that closes only when the switch plunger is moved out of its "OFF" position.

The coupling between the armature and the rotary disk should be provided with an additional spring element, for the following reason. It the switch was in the ON position and the disk was brought into the "decoupled" position as a result of failure of the mains supply voltage, the contact piece has sprung into the OFF position while the plunger has remained in she position. Since the contact piece is in the OFF position, the contacts are open. If the voltage is now applied again, this being the classic case of restart protection, the electric power tool does not start up, because the main contacts are open. Nevertheless, the electromagnet already brings the disk back into the "coupled" position. In order to deactivate the restart protection, the external locking must now be released by actuation of the slide or paddle. When the external actuator returns to its "OFF" position as a result, it also allows the switch plunger to return to the OFF position. Since the rotary disk is already in the "coupled" position, however, a resiliently rotating snap connection must be realized by means of the above-mentioned spring element and an appropriate gate element between the disk and plunger. As the plunger is raised, the gate element forces the disk temporarily, against the spring force, into the "decoupled" position, in order then to snap it into the "coupled" position upon attainment of the end position. Coupling can thus be achieved in two ways, namely:

a) plunger and contact piece in the OFF position, after which the disk is brought into the "coupled" position.

b) plunger in the ON position, contact piece in the OFF position and rotary disk in the "coupled" position, after which the plunger is brought into the OFF position, the disk is briefly displaced and snaps back in.

This mechanism described above is necessary primarily to allow an electromagnet realized as a stroke magnet to permanently attain the maximum operating position, when energized, in each switching case. In this position, there is the least current consumption and heating of the coil, but the greatest armature force. This condition ensures that the magnet can be optimally designed for 100% operating time with a minimal structural size. The minimal structural size of the magnet, in turn, is decisive for the structural size of the switch. The structural size of the switch is important, owing to the only very limited structural space available in the electric power tool.

Instead of an electromagnet realized as a stroke magnet, a holding magnet may also be used for the switch. In this case, it is advantageous that such a holding magnet has a lesser current consumption, that the holding magnet does not have to perform any stroke work, and that the holding magnet is of a smaller structural size. The functioning of the holding magnet in this case is as follows.

The "coupled" position of the coupling element is held as long as the holding magnet is energized. The stroke work required to bring the coupling element from the "decoupled" position into the "coupled" position is effected by the restoring spring of the contact piece, via an oblique gate element between the contact piece and the transmission element realized, for example, as a slide, in the switch-off operation. This means that, when the contact piece moves upward, i.e. as a result of a normal switch-off or as a result of decoupling in the case of power failure, the slide is tensioned against its restoring spring via the oblique gate element. As a result, the coupling element can be rotated by its restoring spring into the "coupled" position. The restoring spring of the rotary disk is now in a different place, but is still acting in the "coupled" direction. The yoke of the holding magnet should be pressed against the holding magnet by means of a light spring, since it is only without an air gap that the full holding force is deployed.

Furthermore, clearly, the coupling element may be designed not only as a rotary disk, but also in a different way. Thus, other designs of the coupling element that may be used are, for example, a rotary pin, a rotary lever or the like.

In summary, the following may be stated regarding the principle of functioning of the switch according to the present invention.

When voltage is applied to the switch, the armature is held by the electromagnet. As a result, the transmission element, for example, realized as slide, is also held in its position. The coupling element, for example, the rotary disk, rotary pin, rotary lever or the like, is held in the coupled position by a compression spring. The coupling element is mounted in a rotatable manner on the contact piece. The coupling is effected between the coupling element and the plunger, for example, realized as a pressure piece.

In the coupled position, the pressure piece strikes a particular region of the coupling element and thereby drives the latter and the contact piece. In the decoupled position, the pressure piece does not strike this particular region of the coupling element, and cannot drive the latter together with the contact piece.

The decoupling is initiated by the slide. If there is no longer any voltage applied to the switch, the electromagnet no longer holds the armature. As a result, the slide is also no longer held at its position. In this situation, the slide is moved by one or more compression springs. With this movement, the coupling element is rotated into the decoupled position.

The advantages achieved with the present invention consist, in particular, in that the switch fulfills the requirement, arising from the amended appliance standard, for a restart protection. As a result of the restart protection being integrated in the switch, no alteration, or only very little alteration, of the design of the appliance and/or of the appliance wiring is required. The switch according to the present invention with restart protection can easily be substituted for a conventional switch without restart protection. The appliance manufacturers can thus use the same appliance platform for countries in which the restart protection is prescribed and for those in which it is not required. The proposed solution is equally suitable for paddle actuation and for slide actuation of the appliance. Furthermore, there is increased added value in comparison with a simple switch without restart protection. In comparison with a solution with a separate electronic module for the restart protection, the wiring and assembly of the device having a switch according to the present invention is considerably more simple and cost-effective. In this case, there are no additional wires and/or connections.

BRIEF DESCRIPTION OF THE DRAWINGS

An exemplary embodiment of the present invention, with various developments and embodiments, is represented in the drawings and described in greater detail in the following. There are shown in FIG. 1 an electrical switch, in perspective view, FIG. 2 the complete electrical switch from FIG. 1 in a top view, the top cover having been removed from the enclosure, FIG. 3 the switch as in FIG. 2, in perspective view, FIG. 4 the switch as in FIG. 3, but from the other side, FIG. 5 the contact system of the switch, the enclosure having been removed, FIG. 6 a detail from FIG. 5, in perspective view, FIG. 7 the plunger from FIG. 6, as a single part, in a detail view, FIG. 8 the rotary disk from FIG. 6, as a single part, in a detail view, FIG. 9 parts for the actuation of the contact system together with the actuator, in perspective view, the enclosure having been removed, FIG. 10 to FIG. 20 the contact system together with actuator as in FIG. 9, but in differing positions, according to their mode of operation, FIG. 21 an electric appliance having an electrical switch, in a schematic representation, FIG. 22 the complete electrical switch according to a further embodiment, in top view, the top cover having been removed from the enclosure, FIG. 23 to FIG. 27 the contact system of the switch from FIG. 22 with the associated elements for actuation, but in differing positions, according to their mode of operation, FIG. 28 the complete electrical switch according to another further embodiment, in top view, top cover having been removed from the enclosure, FIG. 29 the contact system of the switch from FIG. 28 with the associated elements for actuation, FIG. 30 the complete electrical switch according to yet another further embodiment, in no view, the top cover having been removed from the housing, and FIG. 31 the contact system of the switch from FIG. 30 with the associated elements for actuation.

DETAILED DESCRIPTION OF THE INVENTION

Figure 1:
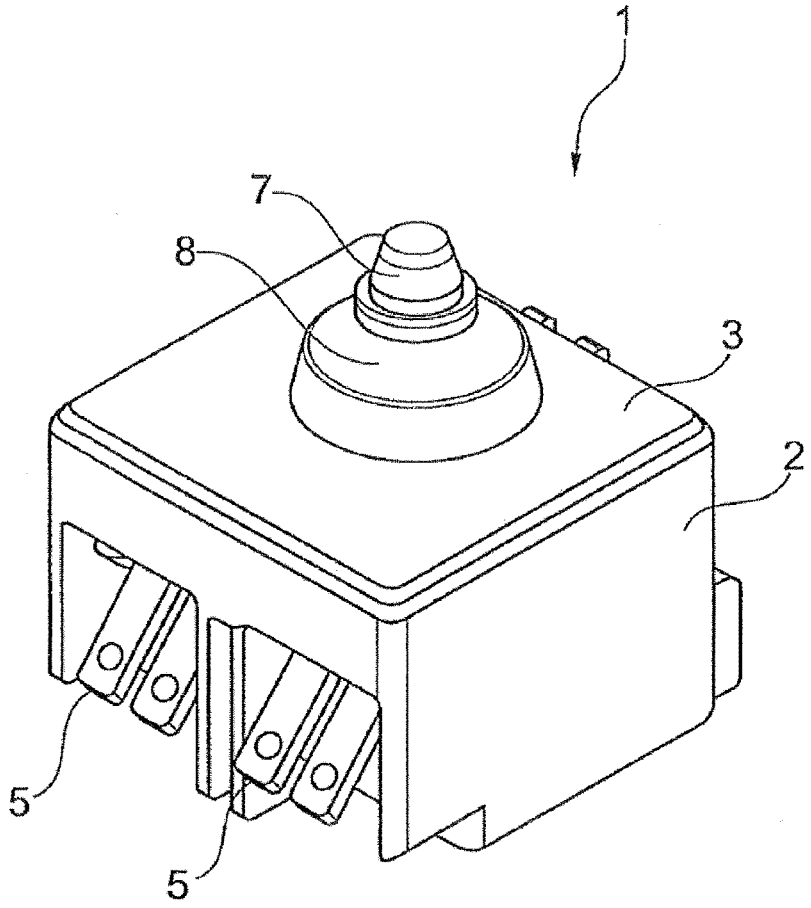

FIG. 1 shows an electrical switch 1 for an electric power tool operated by means of mains supply voltage. The switch 1 has a contact system 6 and serves as an on/off switch for the electric motor 22 of the electric power tool 21, as is further shown by FIG. 21. At least one electrical connection 4 is provided for supplying the voltage, i.e. the mains supply voltage, to the contact system 6. Also provided is at least one further electrical connection 5, for taking off the voltage switched by means of the contact system 6, this voltage then being supplied to the electric motor 22. Finally, the switch 1 has a movable actuating means 7 for switching the contact system 6.

The actuating means 7, for its part, is moved by an actuating element 23 that is present on the electric power tool 21 and that can be moved, according to the double arrow 24, by the user, the switch 1 actuated indirectly. In the corresponding actuation position of the actuating element 23, in which the switch 1 is switched on, the actuating element 23 can be locked by the user by means of a locking element 25 present on the electric power tool 21. For this purpose, upon corresponding movement according to the swivel arrow 26, a hook 27 on the locking element 25 engages corresponding groove 28 on the actuating element 23. It is therefore not necessary for the user to keep hold of the locked actuating element 23 while operating the electric power tool 21, this being advantageous, in particular, in the case of continuous operation of the electric power tool 21.

However, if there is a failure of the mains supply voltage and the latter is subsequently restored, then, if a switch 1 has been switched on, the electric motor 22 restarts in an uncontrolled manner, this being the case, in particular, if the actuating element 23 has been locked. It is immediately evident that this results in a high risk of accident caused by the electric power tool 21. To avert this risk, the switch 1 is realized in such a manner that a restart protection for the electric motor 22 is realized by the switch 1 in these cases.

Figure 2:
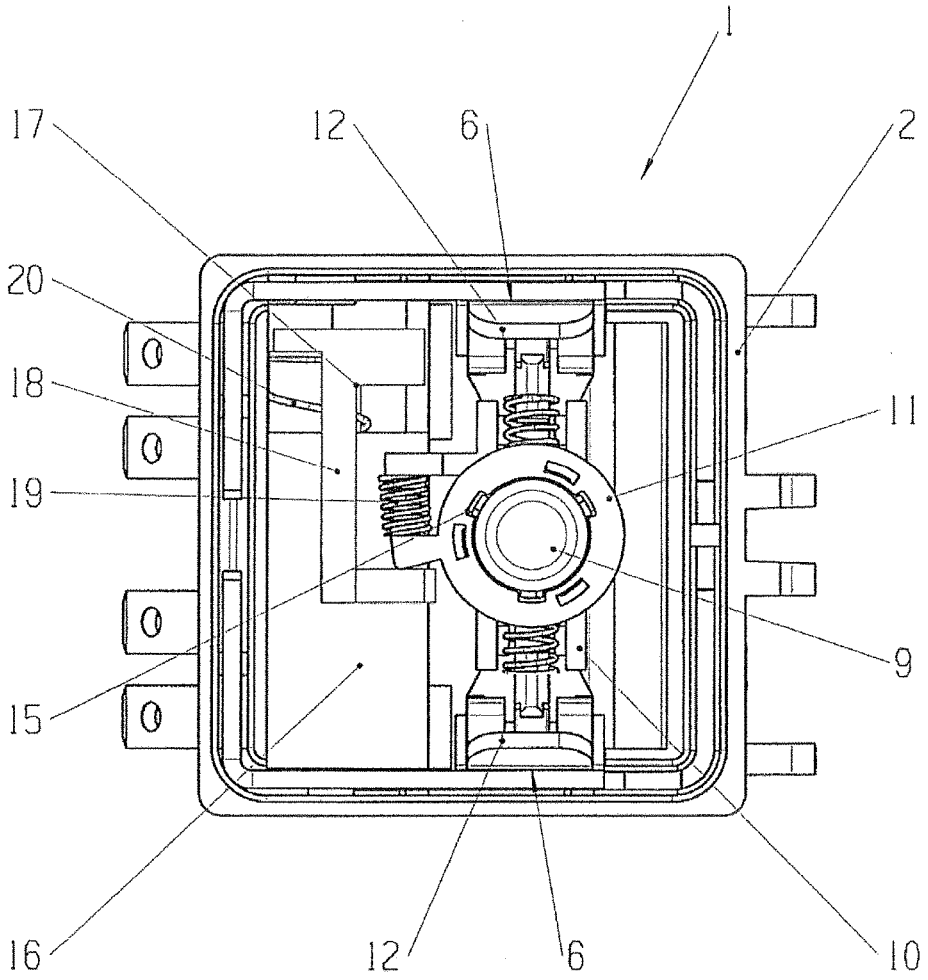
Figure 3:
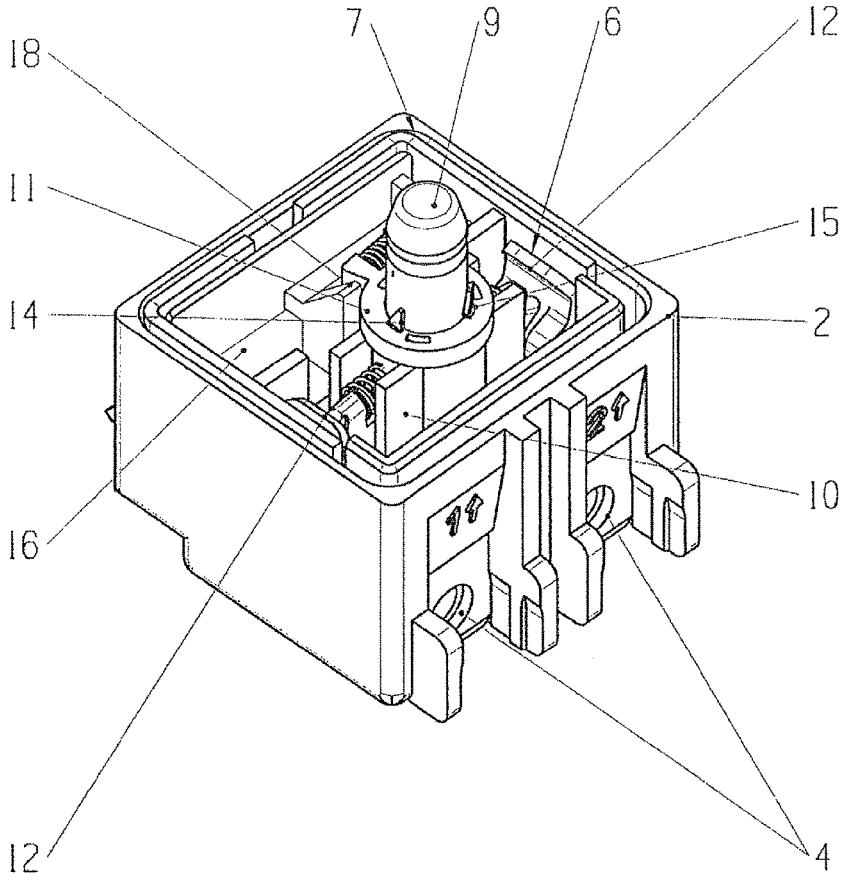
Figure 4:
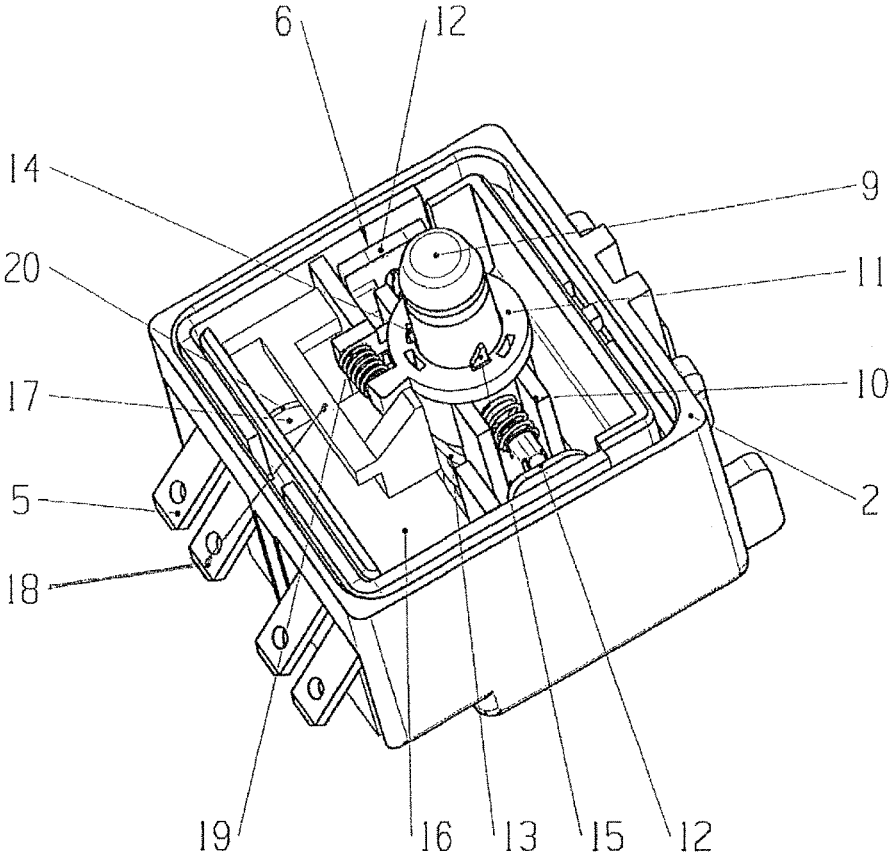

As again shown by FIG. 1, the switch 1 has an enclosure 2, which comprises a top cover 3. On the enclosure 2 are the electrical connections 4 (see FIG. 3) for supplying the mains supply voltage, and the electrical connections 5 for the feed conductors to the electric motor 22. In the enclosure 2, according to FIG. 2, FIG. 3 or FIG. 4, is the contact system 6, which can be switched between an of position and an on position, for switching the electric power tool 21 on/off. The movable actuating means 7 for switching the contact system 6 projects out of the enclosure 2, as shown by FIG. 1. The actuating means 7 is sealed on the top cover 3 by means of an elastic bellows 8.

Figure 5:
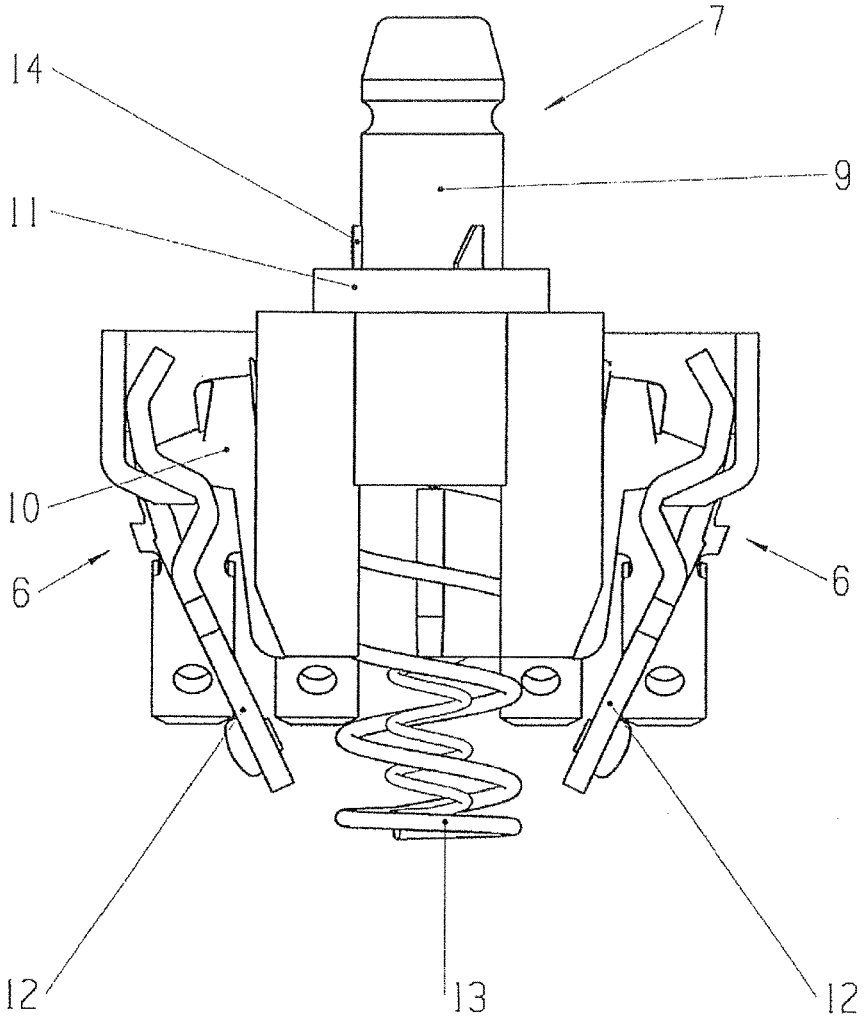
Figure 6:
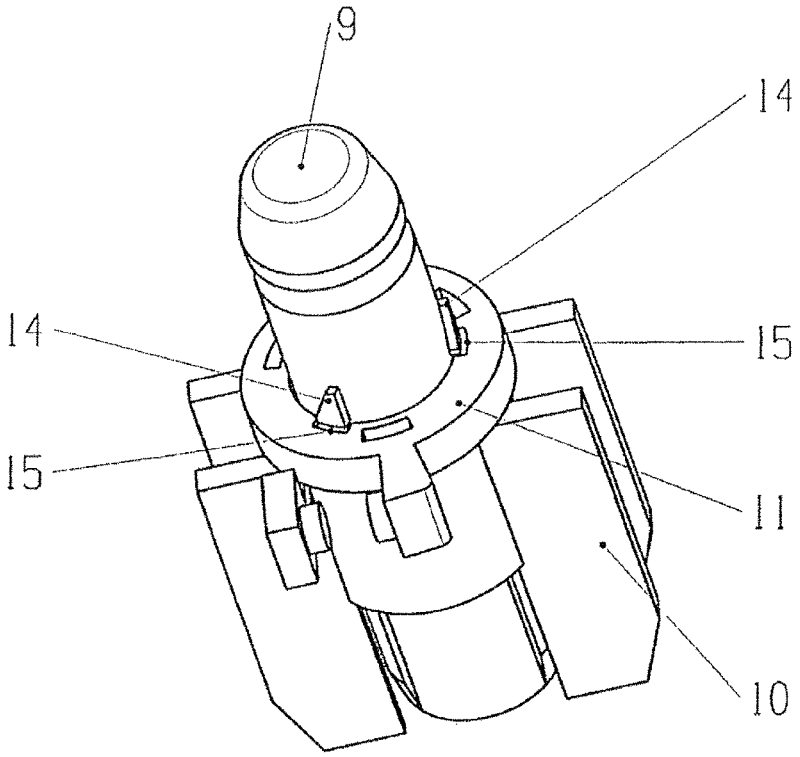

As further shown by FIG. 5, the actuating means 7 comprises a plunger 9 and a contact piece 10. The contact piece 10 in this case acts on the contact system 6 for the purpose of switching. A coupling element 11 is provided, such that the plunger 9 can be brought into and/or out of interaction with the contact piece 10. It is thereby made possible for the contact system 6 to be switched into at least one position by means of the plunger 9, and for the contact system 6 to be switched into at least one position independently of the plunger 9. More precisely, it is made possible for the contact system 6 to be switched into the on position and the off position by means of the plunger 9, and for the contact system 6 to be switched into the off position independently of the plunger 9. In a first embodiment, according to FIG. 6, the coupling element 11 consists of a rotary disk, which is disposed in a movable manner on the contact piece 10, i.e. is mounted in a rotatable manner on the contact piece 10.

FIG. 5 shows a more detailed view of the contact system 6 with movable switching contacts 12, the plunger 9, the contact piece 10 provided with a restoring spring 13, and the rotary disk 11. The fixed contacts of the contact system 6, with which the movable switching contacts 12 interact for the purpose of effecting contact, are not shown in this case. The coupling of the plunger 9 and contact piece 10 by means of the rotary disk 11 is shown in greater detail in FIG. 6. In this case, in FIG. 6, in which the compression spring 13 on the contact piece 10 has been omitted, the "decoupled" position is shown. The coupling between the plunger 9 and the rotary disk 11 is effected by means of a gate element 14, which is present on the plunger 9 and which can be seen in FIG. 7, and by means of a gate element 15, corresponding thereto, which is disposed on the rotary disk 11 and which can be seen in FIG. 6.

Figure 9:
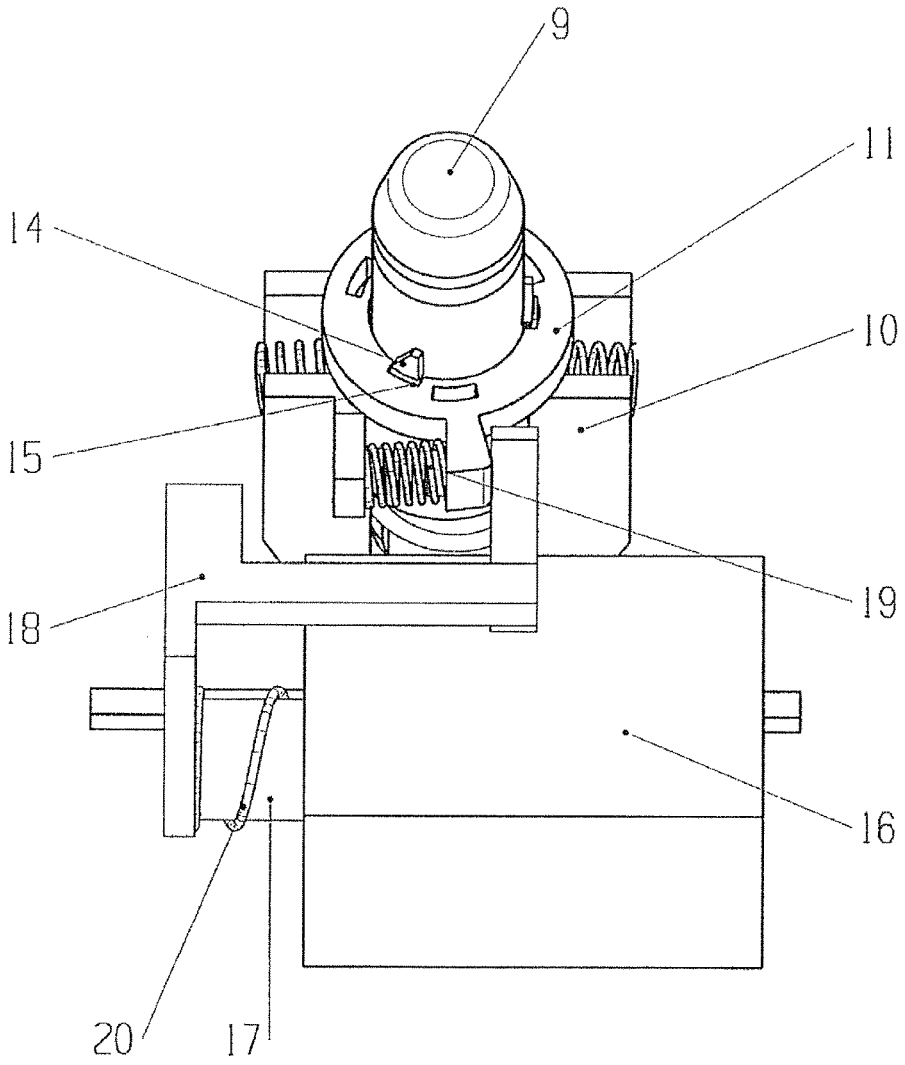
Figure 21:
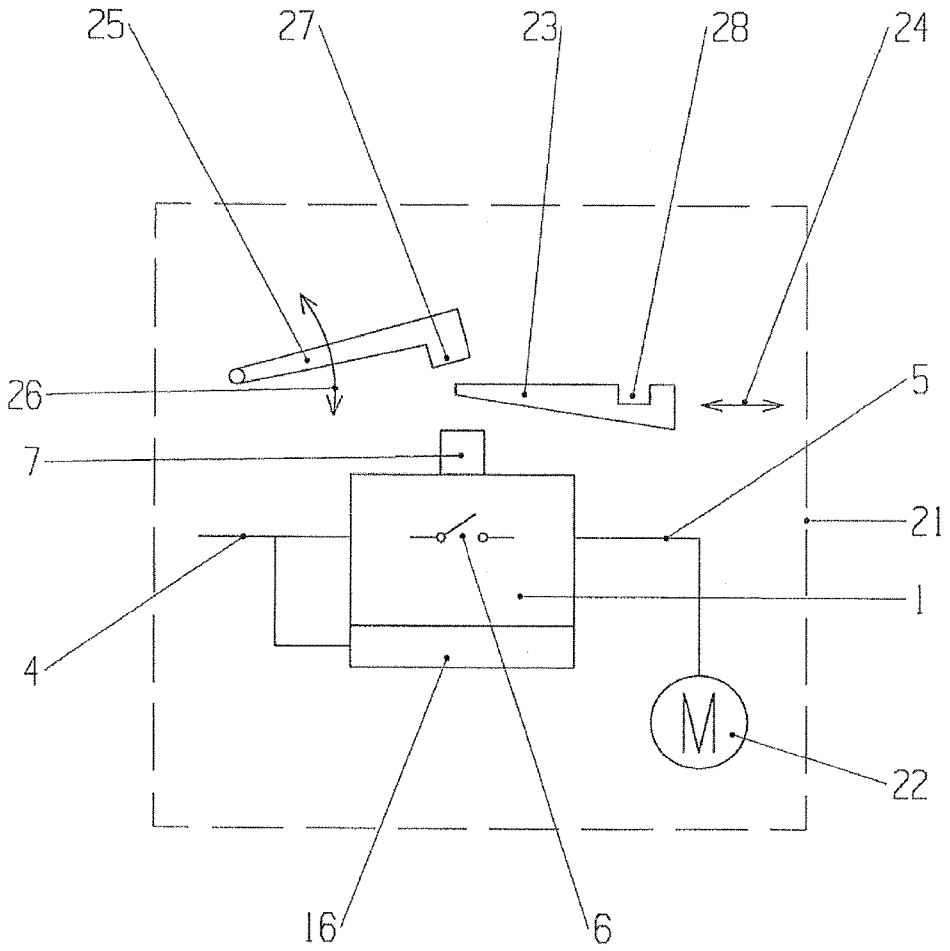

Additionally provided, according to FIG. 4, is an electromagnet 16, this case realized is a stroke magnet, having a stroke rod 17 as an actuator, and a fork element 18 as a transmission element for moving the coupling element 11. For the purpose of being supplied with voltage, the electromagnet 16 is likewise connected to the mains supply voltage, via the connection 4, as shown in FIG. 21. The coupling between the stroke magnet 16 and the rotary disk 11 is shown in detail in FIG. 9, the compression spring 19 being tensioned between the contact piece 10 and the rotary disk 11. Consequently, in a first position of the coupling element 11, the plunger 9 is in interaction with the contact piece 10 and, in a second position of the coupling element 11, the plunger 9 is out of interaction with contact piece 10, as is to be explained in greater detail in the following.

The sequence relating to the functioning of the electrical switch 1 is now described on the basis of FIG. 10 to FIG. 20.

Figure 10:
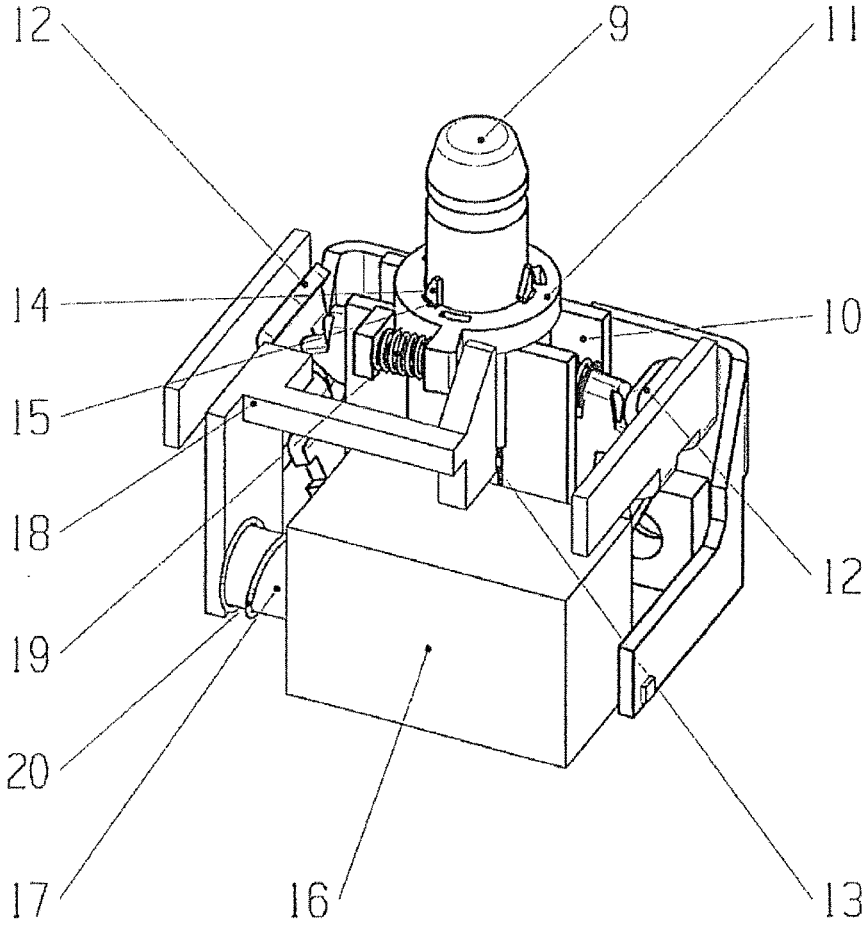

In FIG. 10, the contact system 6 is in the OFF position, the switching contacts 12 being open. The electromagnet 16 is not energized. The rotary disk 11 is in the "decoupled" position.

Figure 7:
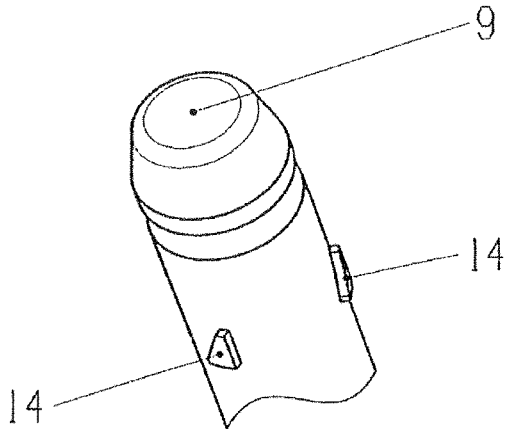
Figure 8:
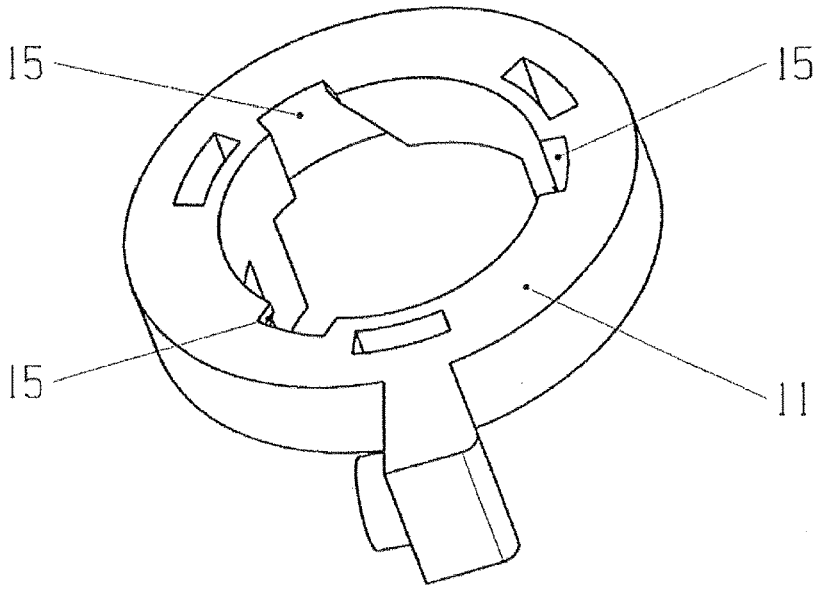
Figure 11:
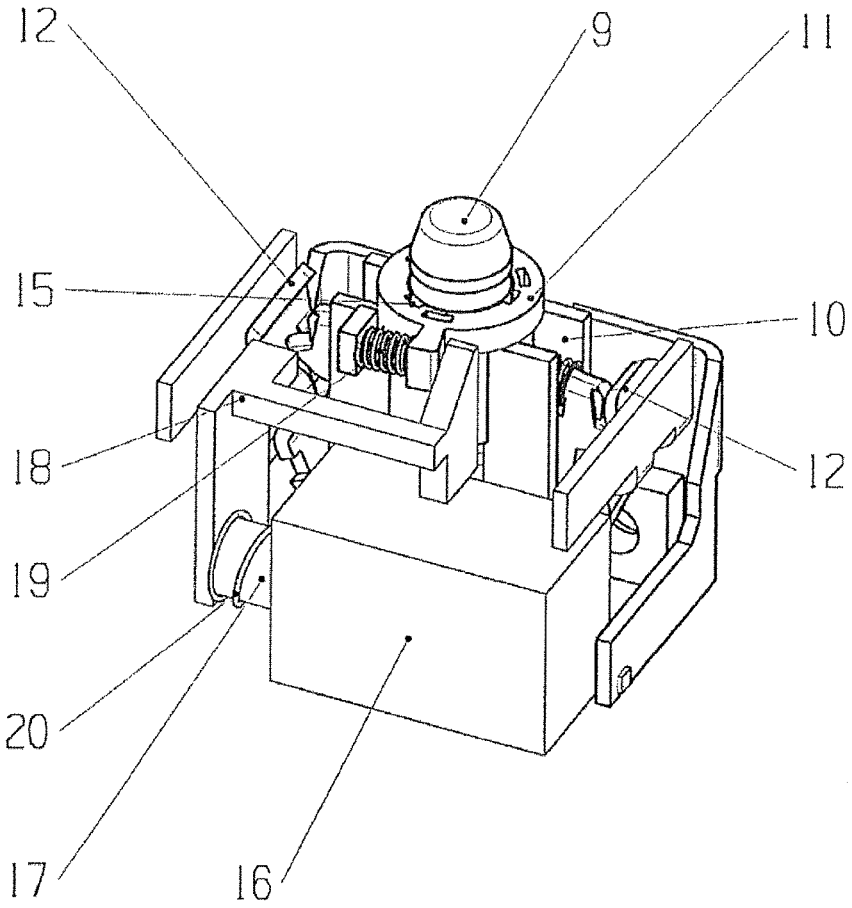

In FIG. 11, the switch 1 and the plunger 9 are actuated. The switching contacts 12 of the contact system 6 are open. The electromagnet not energized. The rotary disk 11 is in the "decoupled" position. The plunger 9 can go through the rotary disk 11 and the contact piece 10, since the gate elements 14, (see FIG. 7 and FIG. 8 are in alignment with each other. Consequently, they are not driven by the plunger 9.

Figure 12:
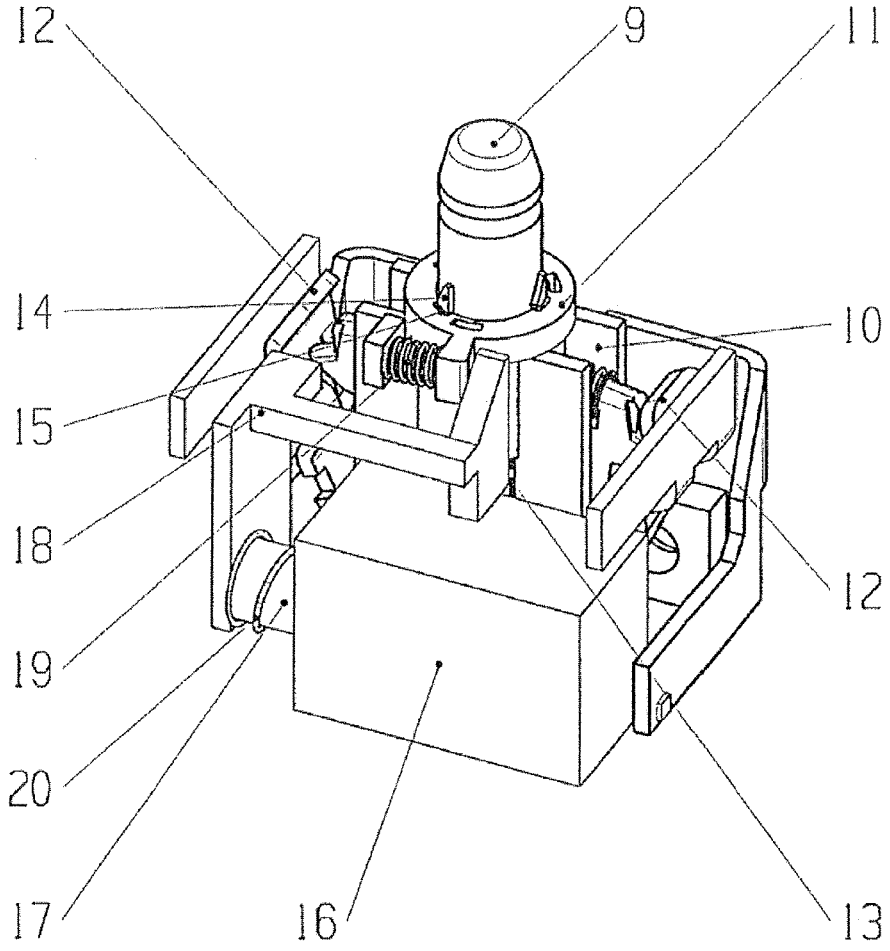

In FIG. 12, the contact system 6 is in the OFF position, the switching contacts 12 being open. The electromagnet 16 is not energized. The rotary disk 11 is in the "decoupled" position.

Figure 13:
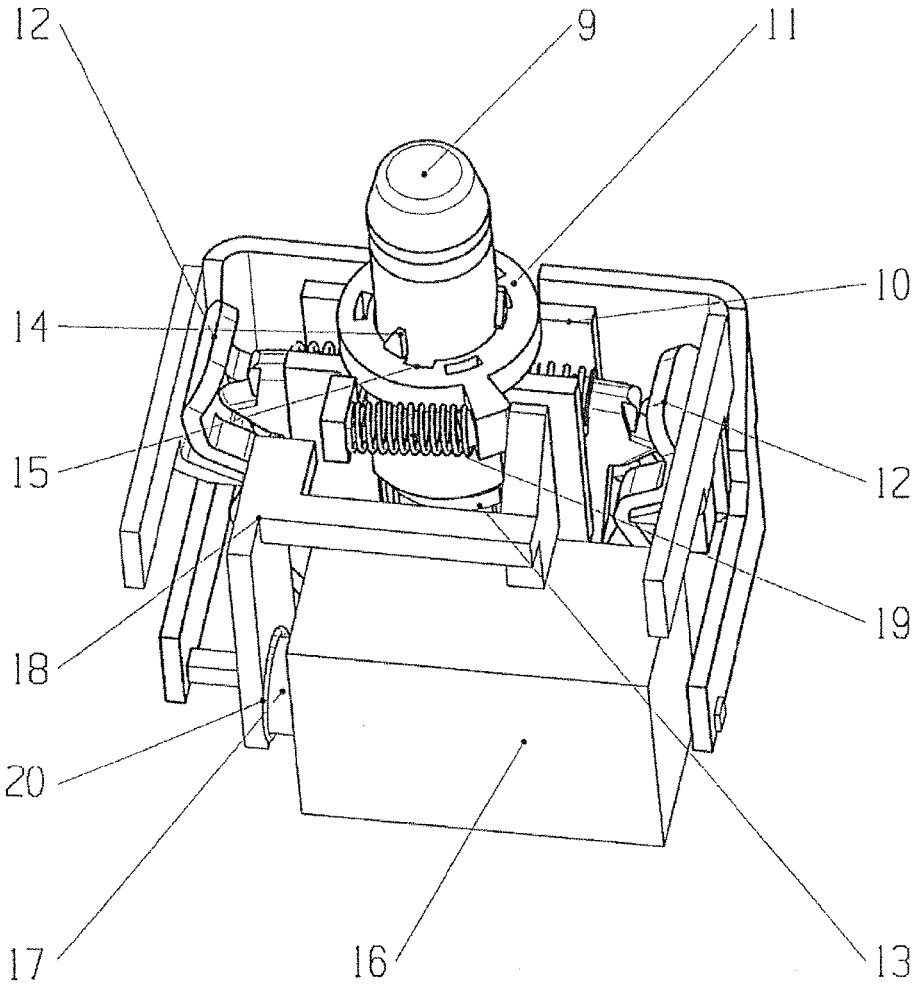

In FIG. 13, the switching contacts 12 are open. The electromagnet 16 is energized and consequently the fork element 18 is pulled in. The rotary disk 11 rotates as a result of the force of the compression spring 19 between the contact piece 10 and the rotary disk 11, such that the gate elements 14, 15 (see FIG. 7 and FIG. 8) are no longer in alignment with each other. The rotary disk 11 is therefore in the "coupled" position.

Figure 14:
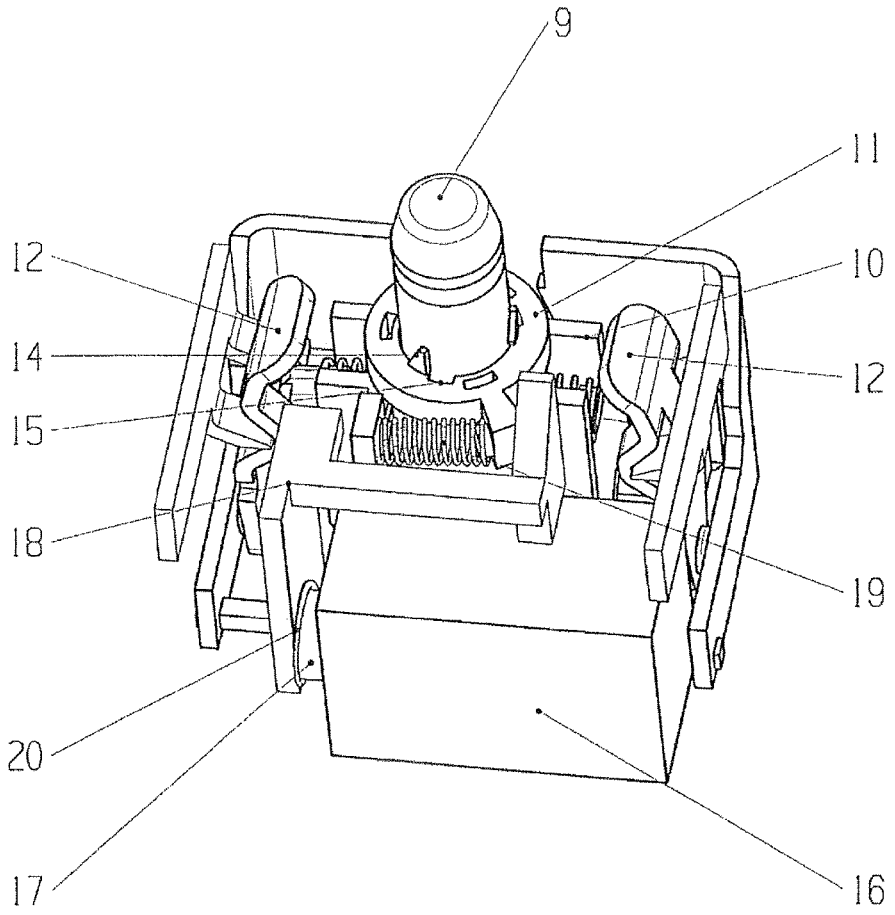

In FIG. 14, the switch 1 and the plunger 9 are actuated. The switching contacts 12 are closed. The electromagnet 16 is energized. The rotary disk 11 is in the "coupled" position.

Figure 15:
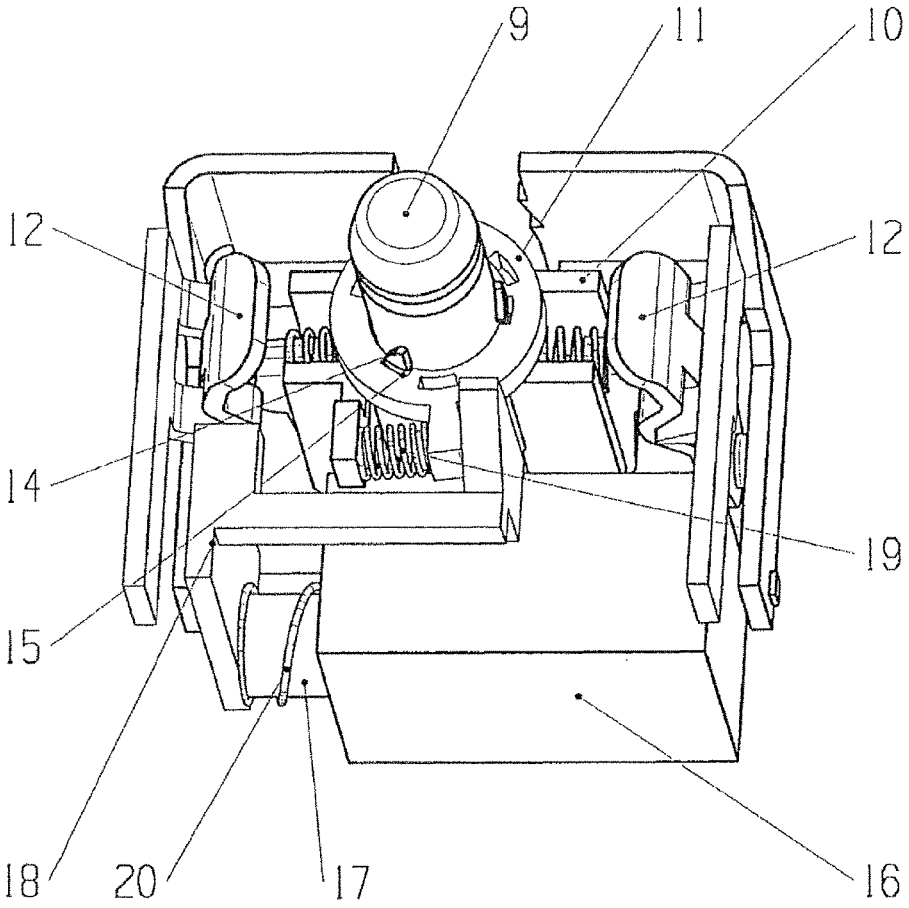

In FIG. 15, the switch 1 and the plunger 9 are actuated. The switching contacts 12 are still closed. The mains supply voltage at the switch 1 drops off, such that the electromagnet 16 is therefore no longer energized. The rotary disk 11 is rotated into the "decoupled" position by the force of the restoring spring 20 of the electromagnet 16, by means of the fork element 18.

Figure 16:
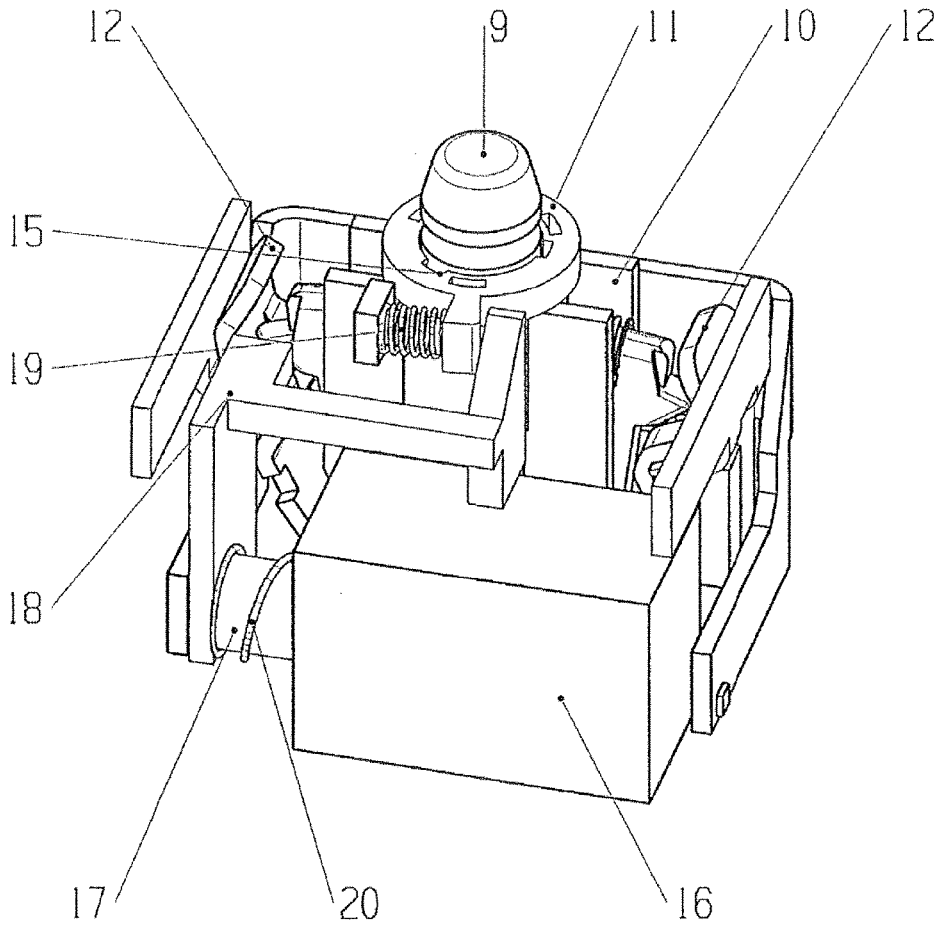
Figure 17:
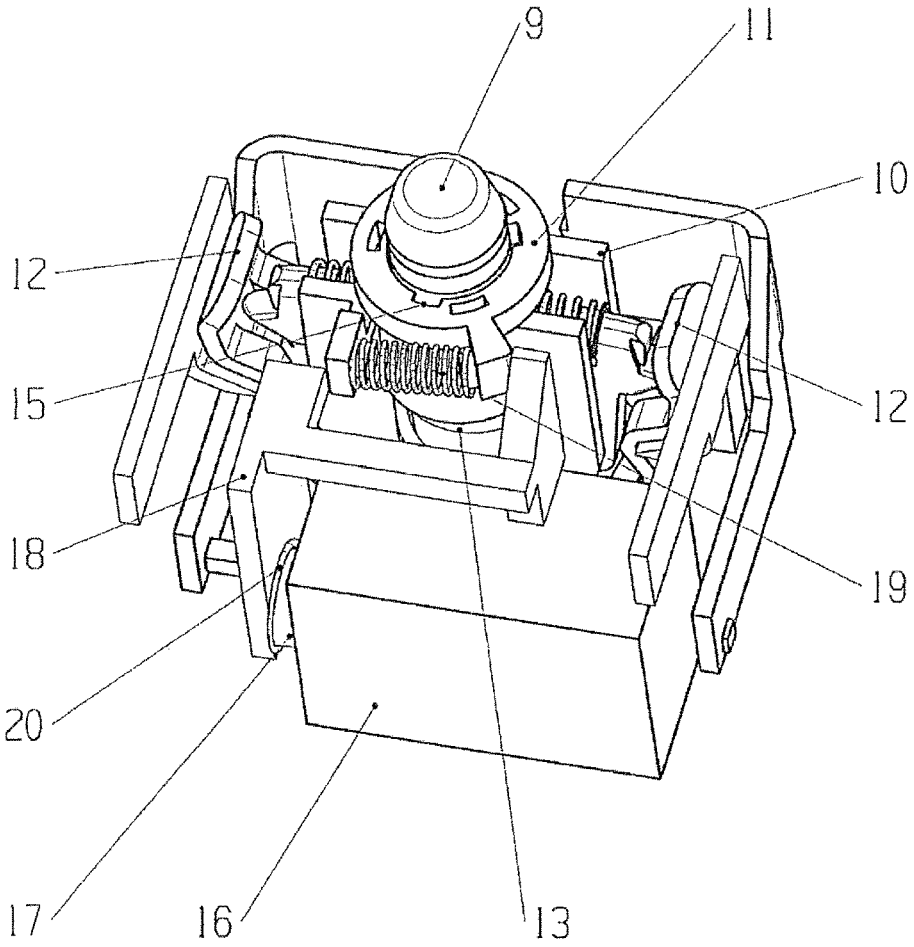
Figure 18:
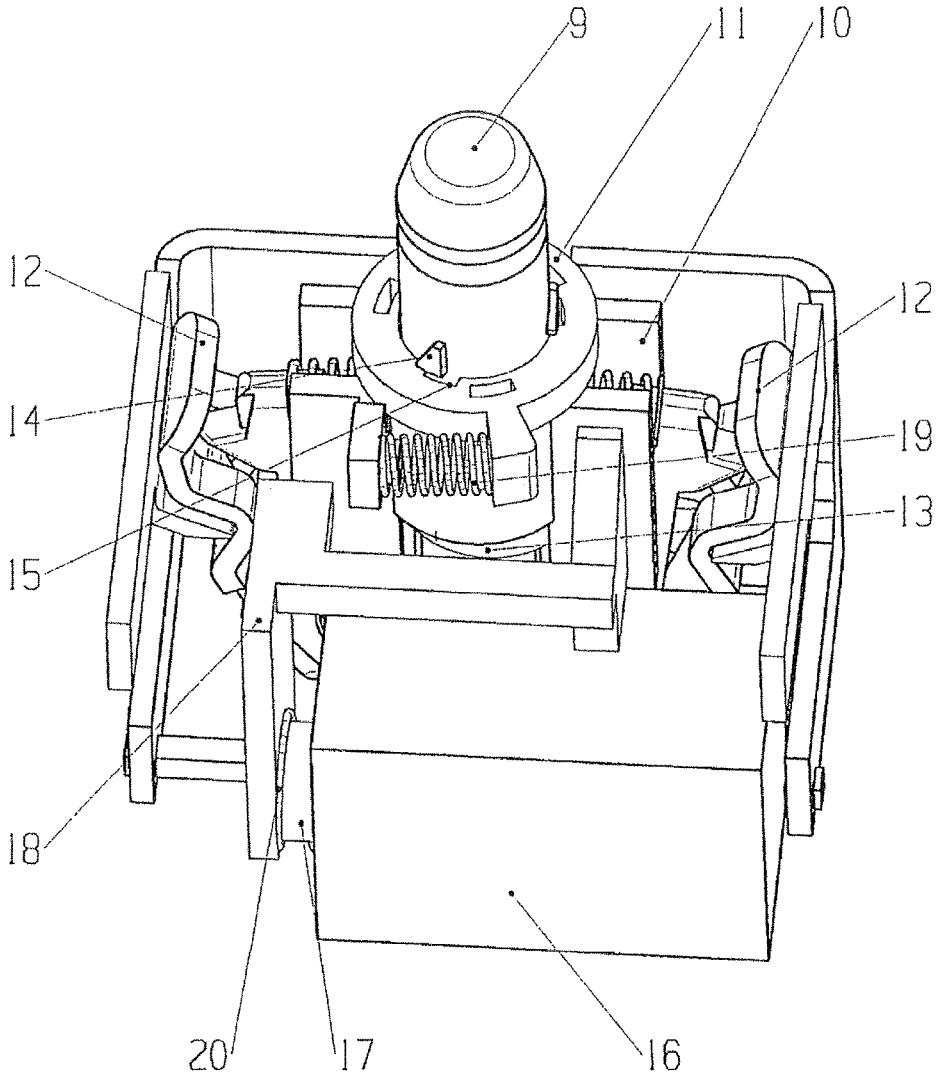

In FIG. 16, the switch 1 and the plunger 9 are still actuated. The switching contacts 12 are open. The electromagnet 16 is not energized, since the mains supply voltage has dropped off. If the mains supply voltage is then restored, which occurs after the mains supply plug of the electric power tool 21 has been inserted or at the end of the outage of the mains supply voltage, the following happens, as shown by FIG. 17. The switch 1 and the plunger 9 are actuated and the switching contacts 12 are open, since the contact piece 10 is in the OFF position. The electromagnet 16 is energized. The rotary disk 11 is brought into the "coupled" position. Upon restoration of the mains supply voltage, the electromagnet 16 can leave the rotary disk 11 in the "coupled" position, but the switching contacts 12 remain open. The same applies to the situation in which the switch 1 of the electric power tool 21 is locked without mains supply voltage in the ON position and the mains supply voltage is then restored. For this case, the switch 1, or the plunger 9, must be released to enable the electric power tool 21 to be switched on again. The switch 1 and the plunger 9 are released, as in FIG. 18, which shows an intermediate position. The switching contacts 12 remain open. The electromagnet 16 is energized. The rotary disk 11 is rotated out of the "coupled" position by the gate element 14 realized, according to FIG. 7, in shape of a wedge, on the plunger 9, and rotated in the direction of the "decoupled" position by the gate element 15, designed to correspond to the latter gate element, as shown by FIG. 8, on the rotary disk 11.

Figure 19:
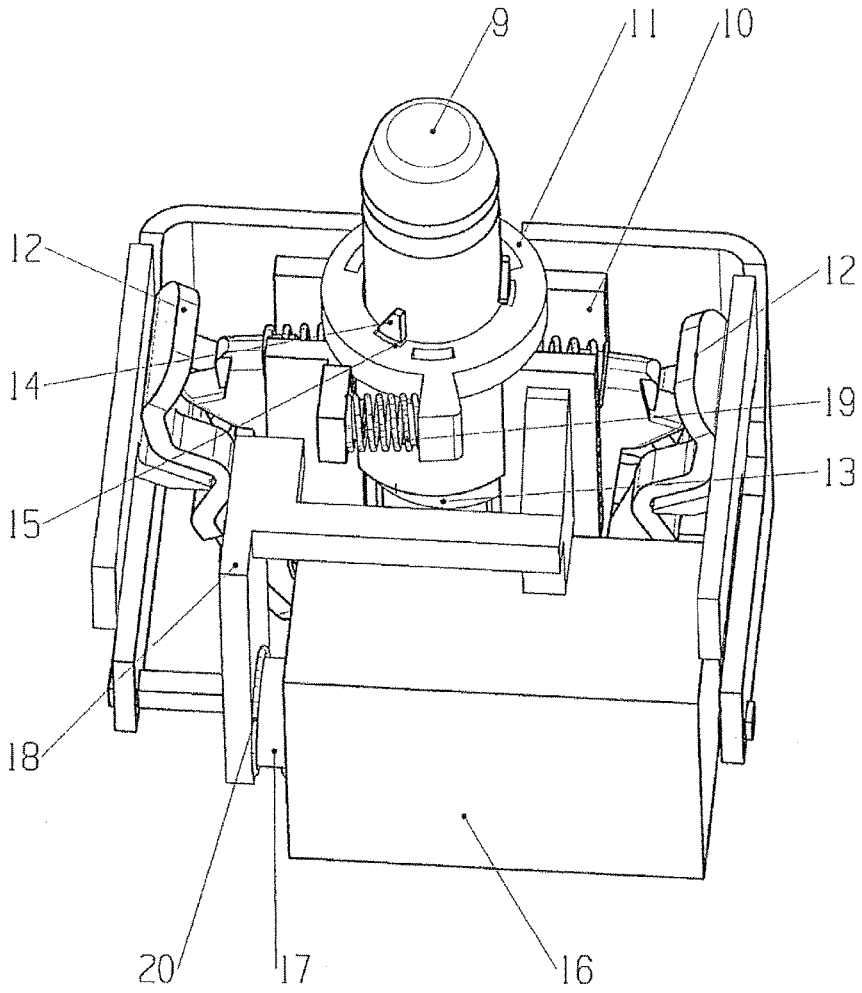

In FIG. 19, switch 1 and the plunger 9 are now fully released. In particular, the switch 1, or the plunger 9, is therefore not locked. The switching contacts 12 are open. The electromagnet 16 is energized. The rotary disk 11 has been rotated into the "decoupled" position and can now snap back into the "coupled" position.

Figure 20:
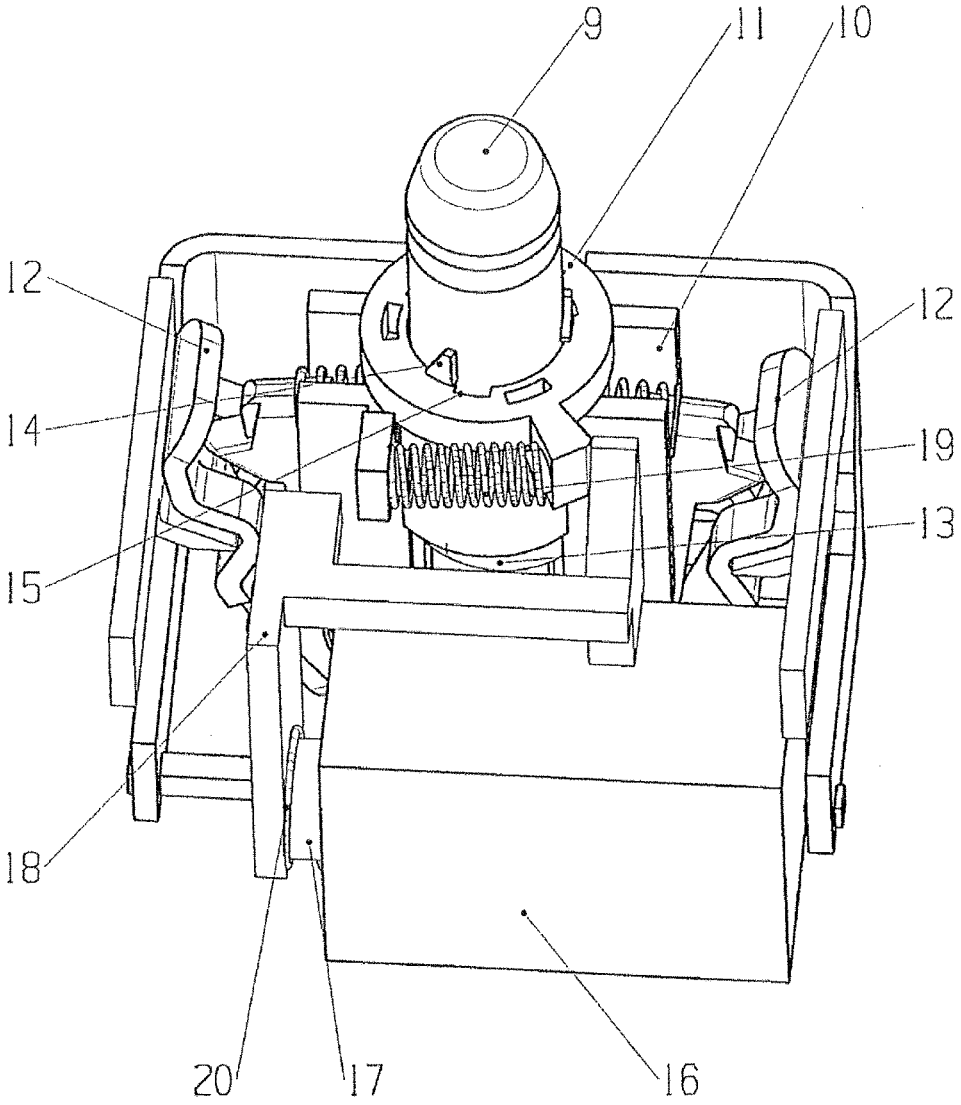

Finally, in FIG. 20, the switch 1 and the plunger 9 are fully released. The switching contacts 12 are open. The electromagnet 16 is energized. The rotary disk 11 has been snapped back into the "coupled" position by the force of the compression spring 19 between the contact piece 10 and the rotary disk 11. The electric power tool 21 can now be switched on again.

Figure 22:
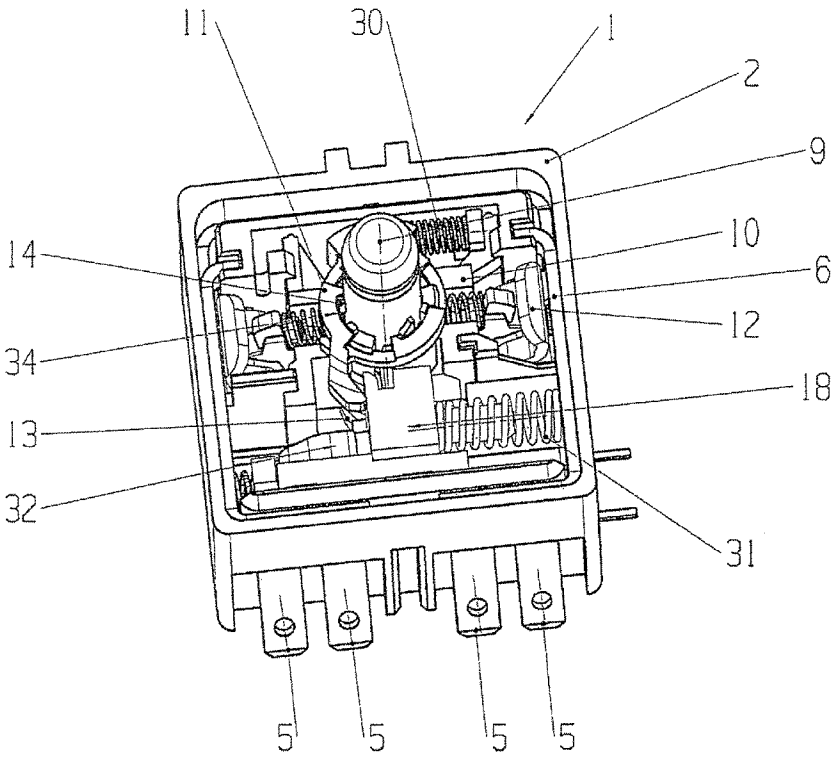

FIG. 22 shows the electrical switch 1 in another embodiment, in which a holding magnet serves as an actuator 16. The switch 1 again has at least one elastic element 13, which acts on the actuating means 7 to restore it to the off position of the contact system 6. As can be seen especially from FIG. 24, this is a compression spring 13 that acts on the contact piece 10. The coupling element 11, which is a rotary disk, is disposed in a movable manner on the contact piece 10, i.e. is mounted in a rotatable manner on the contact piece 10, as shown by FIG. 23.

Figure 23:
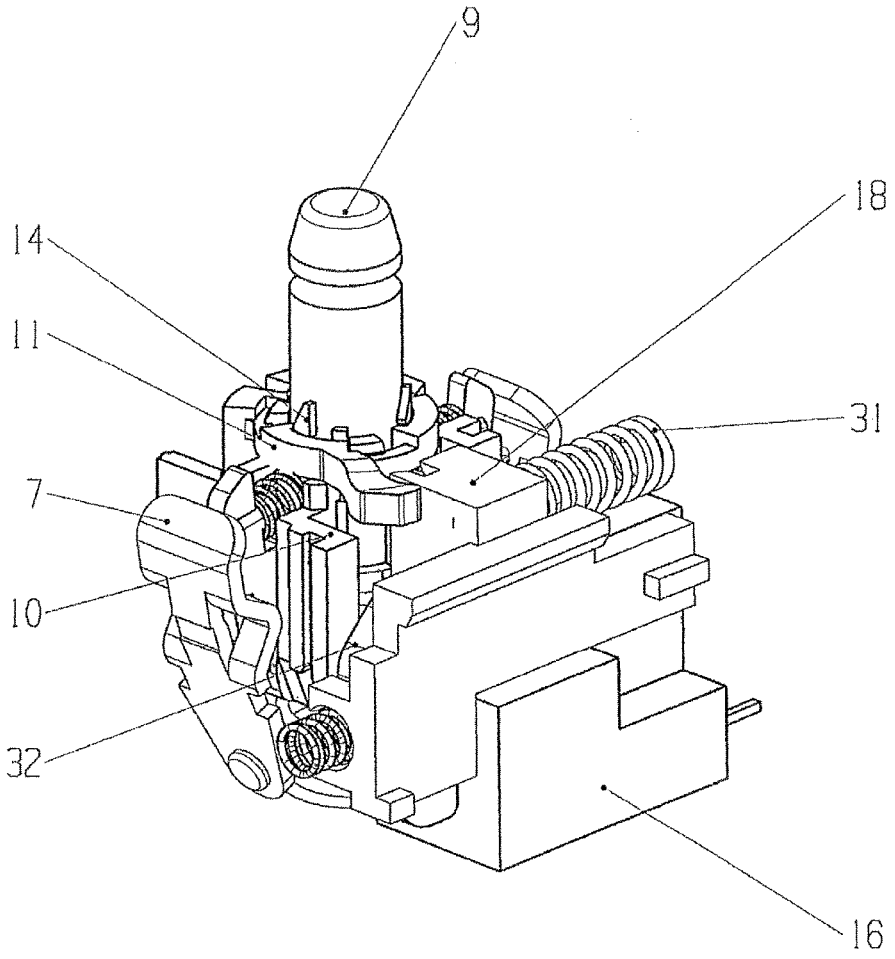
Figure 26:
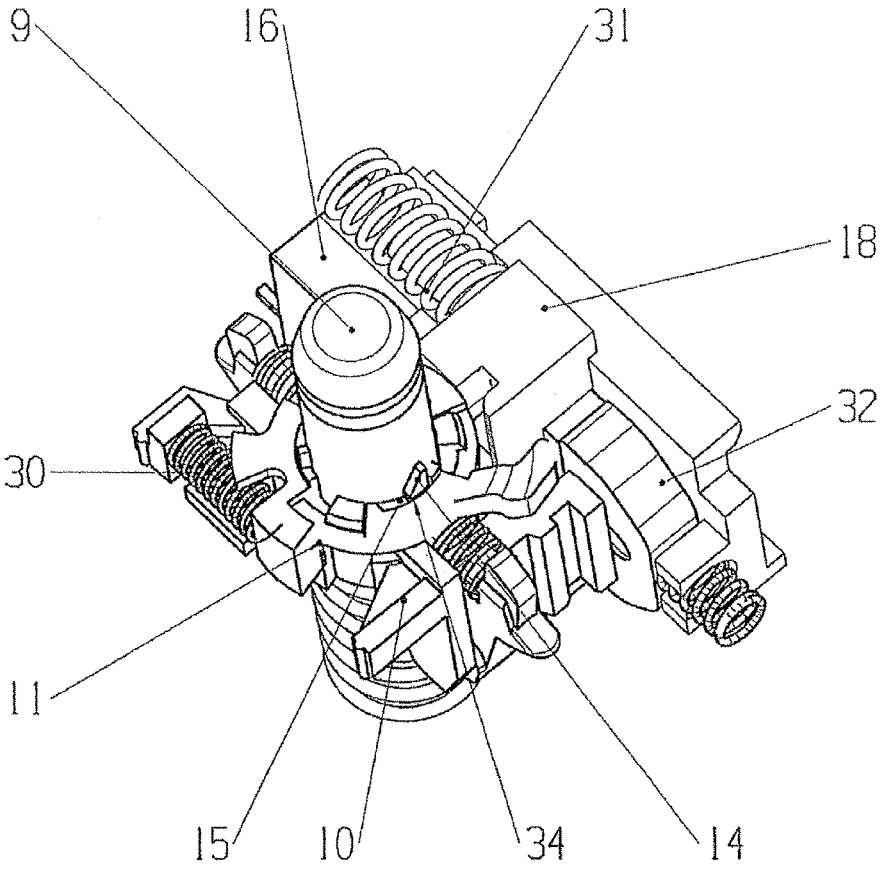

In a first position of the coupling element 11, which is shown in FIG. 23, the plunger 9 is interaction with the contact piece 10. The first position is thus the "coupled" position. In a second position of the coupling element 11, which is shown in FIG. 26, the plunger 9 is out of interaction with the contact piece 10. The second position is the "decoupled" position. The coupling element 11 is held in the first position by an elastic means 30, for example, by a compression spring.

A transmission element 18, which in the present case is realized in the manner of a slide, is provided between the coupling element 11 and the actuator 16 for moving and/or holding the coupling element 11. The transmission element 18, for its part, moves the coupling element 11 into the second position by means of an elastic element 31, i.e. in this case a compression spring.

In this case, as already mentioned, the actuator 16 provided for moving and/or holding the coupling element 11 is an electromagnet, acting as a holding magnet, which at the same time receives the voltage supplied via the connections 4 on the switch (see FIG. 21). Upon receiving the voltage, therefore, the yoke 32 present on the armature of the holding magnet 16 holds the transmission element 18 in place by means of the yoke 32. This is different, on the other hand, in the case of the embodiment according to FIG. 2, in which the electromagnet is realized as a stroke magnet 16 that releases the transmission element 18 upon receiving voltage.

Concerning the more detailed functioning of this embodiment of the switch 1, reference is additionally made to FIGS. 23 to 27, which the enclosure, the connections and the fixed contacts have been omitted for reasons of clarity.

In FIG. 23, the switch 1 can be seen in the OFF position of the contact system 6, while the coupling element 11 is in the coupled position. When current is applied to the switch 1, the holding magnet 16 holds the rotary disk 11 in the coupled position. The switch 1 can then be electrically switched on by means of the plunger 9.

Figure 24:
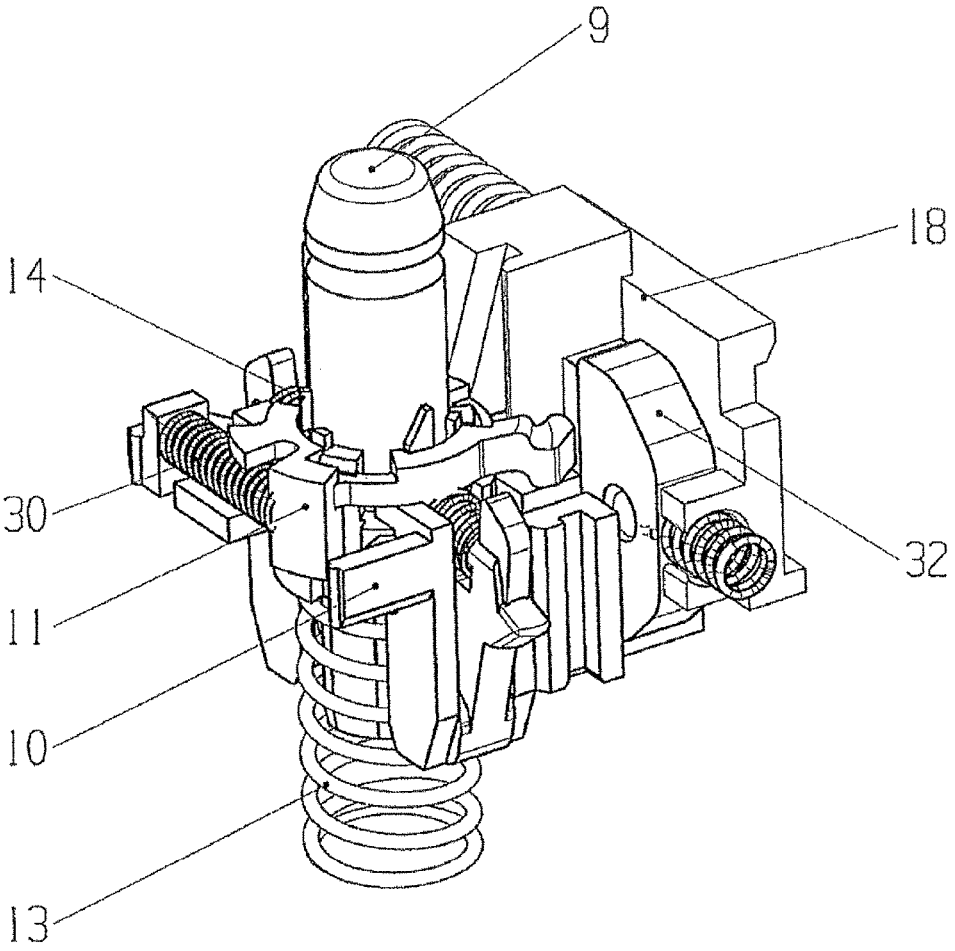
Figure 25:
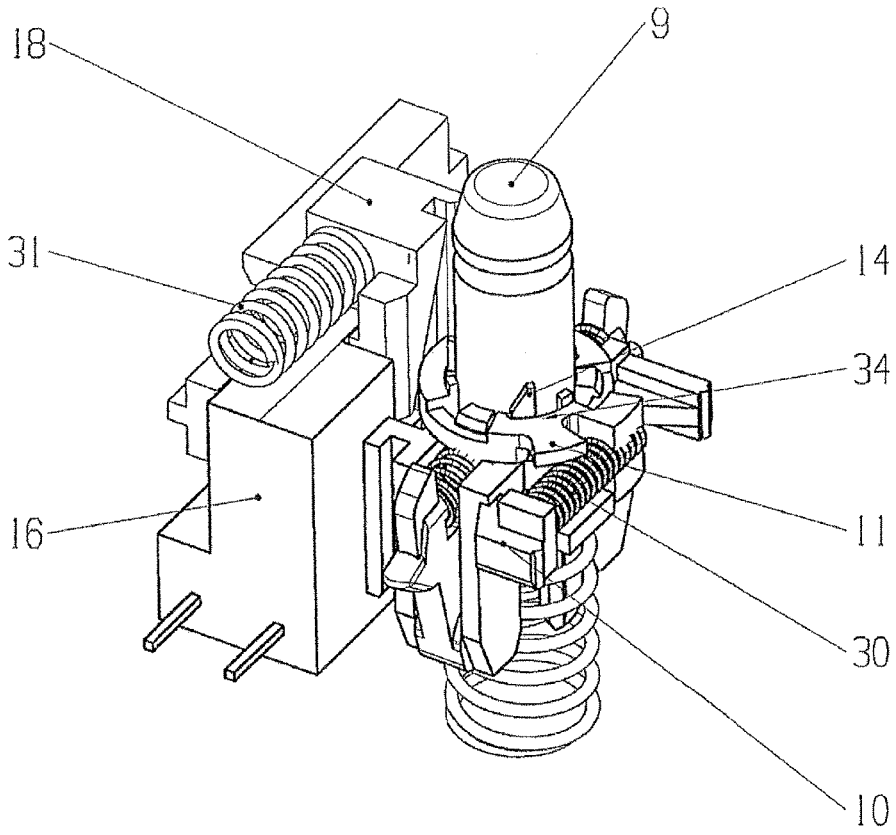

In FIG. 24 and FIG. 25, in which the movable contact carriers have additionally been omitted, the voltage is applied. As a result, the holding magnet 16 is also energized, such that the latter holds the rotary disk 11 in the coupled position. The switch 1 switched on, whereby the plunger 9 has driven the contact piece 10 via the rotary disk 11.

In FIG. 26, the switch 1 is switched on. The plunger 9 is held in the ON position by the locking element 25, by means of the external locking system (see FIG. 21). If the electric power supply fails, the holding magnet 16 releases. The slide 18 is displaced to the right by means of the restoring spring 31. As a result, the rotary disk 11 is rotated into the decoupled position. From this position, the contact piece 10 is shifted upward, into the OFF position, by its restoring spring 13. Upon this upward movement, the slide 18 and the yoke 32 on the holding magnet 16 are shifted back into the holding position by means of the gate elements 14, 15, which constitute the coupling region 34 between the rotary disk 11 and the plunger 9. The rotary disk 11 in this case returns to the coupled position. Since the contact piece 10 is in the OFF position, however, the contacts of the contact system 6 remain open.

Figure 27:
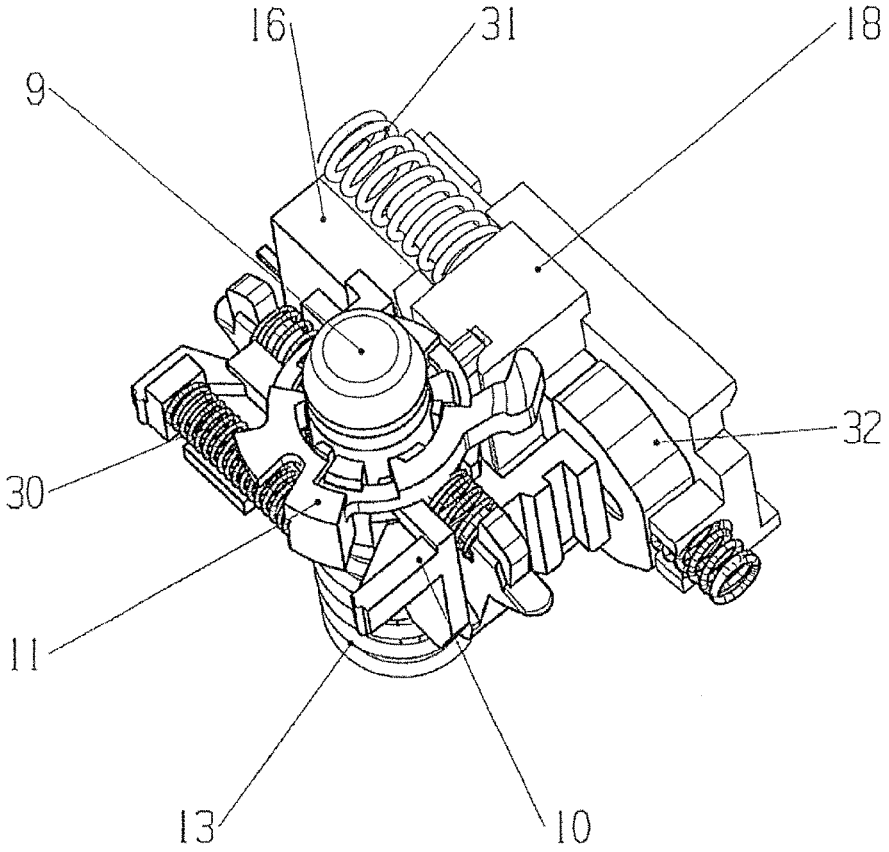

In FIG. 27, the plunger 9 remains in the ON position. As a result of the decoupling, however, the contact piece 10 has sprung upward into the OFF position. The contacts of the contact system 6 are open. The slide 18 has been displaced to the left. If voltage is then applied again to the switch 1, the holding magnet 16 again holds its yoke 32, and consequently the slide 18, in position. The rotary disk 11 is in the coupled position. The coupling with the plunger 9 can only occur, however, if the plunger 9 is brought into the OFF position by releasing the external locking system by means of the locking element 25 (see FIG. 21). The switch 1 can then be switched on again. The coupling region 34 thus has the effect that, upon resetting of the plunger 9 not in interaction with the contact piece 10, the coupling element 11 is moved the second position.

Figure 28:
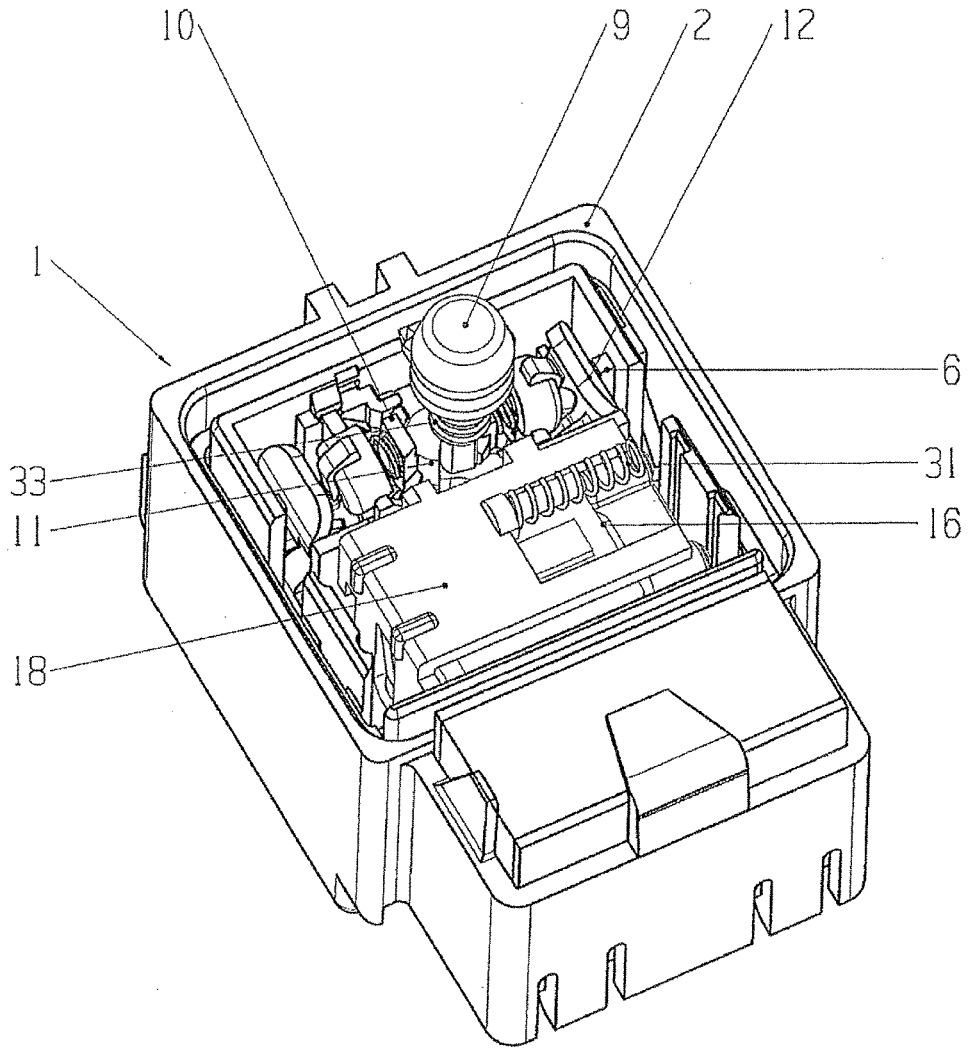
Figure 29:
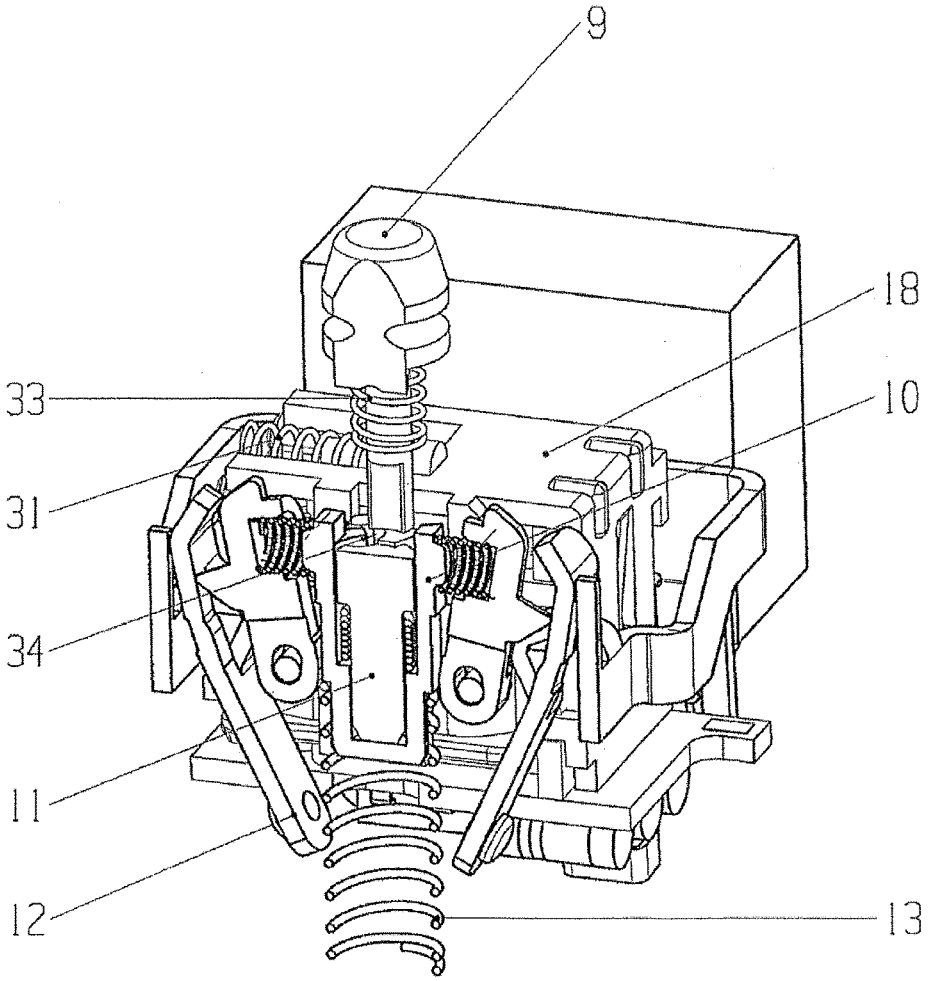

Yet another embodiment for the electrical switch 1 is shown in FIG. 28 and FIG. 29. Here, again, a holding magnet is provided as an actuator 16. However, the coupling element is realized, not as a rotary disk, but as a rotary pin 11, as shown, in particular, in FIG. 29. It is also shown in FIG. 29 that, besides the restoring spring 13 for the contact piece 10, there a further restoring spring 33 provided on the plunger 9, for resetting the latter. In total, therefore, the two restoring springs 13, 33 serve as an elastic element for resetting the actuating means 7. The coupling region 34 between the rotary pin 11 and the plunger 9 is shown clearly in FIG. 29.

Figure 30:
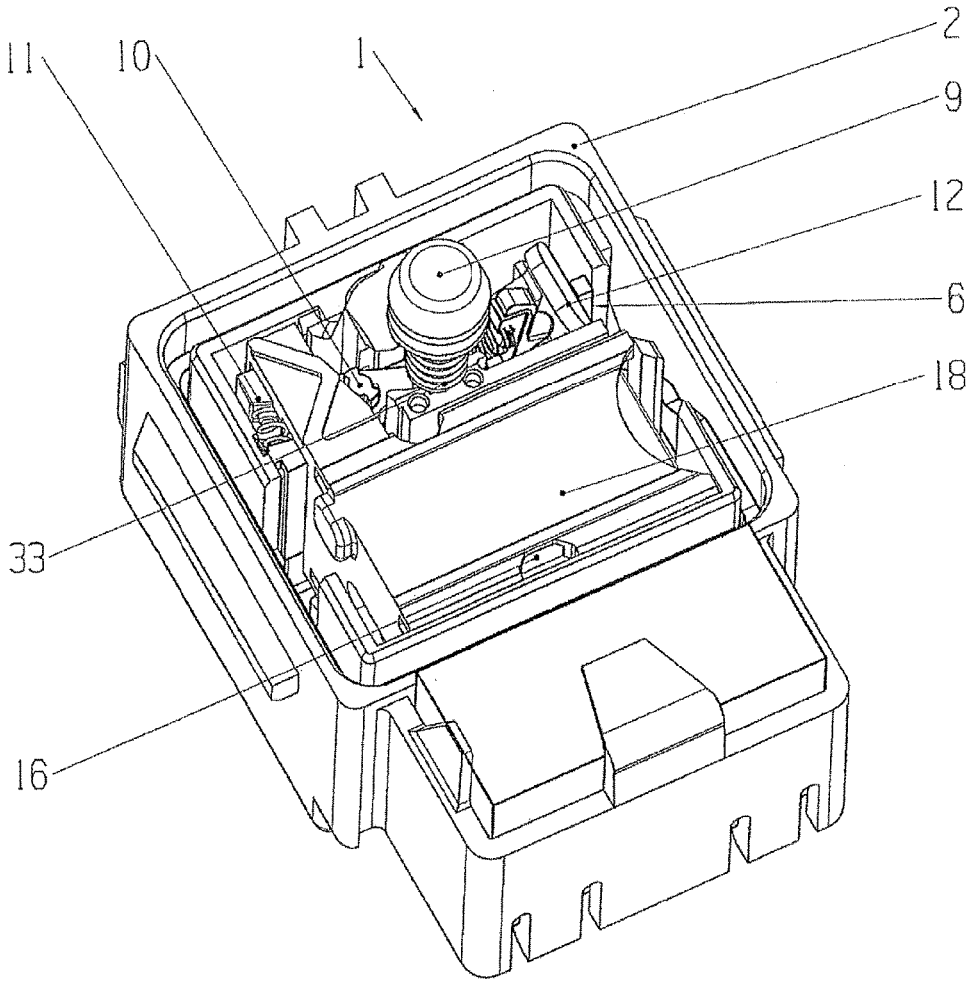
Figure 31:
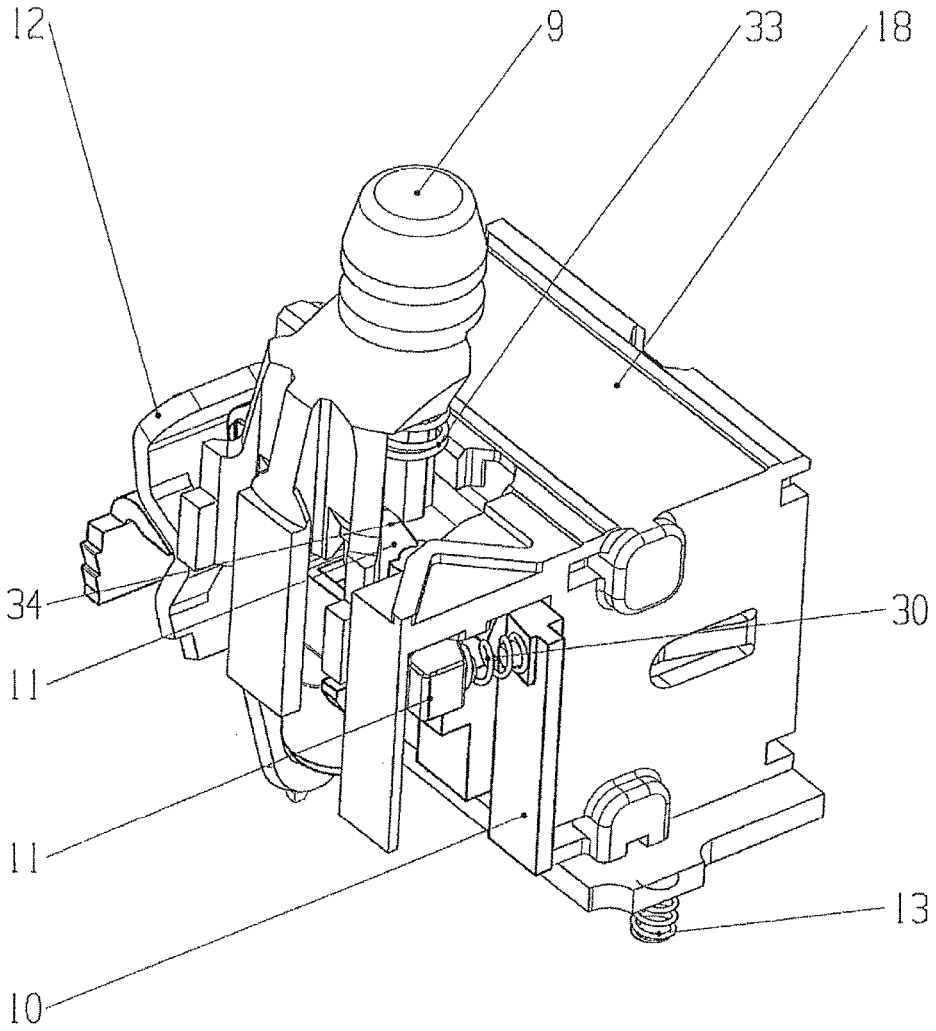

Finally, yet another embodiment of the electrical switch 1 is shown in FIG. 30 and FIG. 31. Again, a holding magnet is provided as an actuator 16. The coupling element in this case is realized as rotary lever 11, which can interact with the transmission element, realized as a slide 18, by means of one lever arm, and with the plunger 9 by means of the other lever arm. The coupling region 34 between the rotary lever 11 and the plunger 9 is shown clearly in FIG. 31.

The present invention is not limited to the exemplary embodiment that has been described and represented. Rather, it also includes all developments by persons skilled in the art within the scope of the present invention defined by the claims. Such an electrical switch 1 may thus be used, not only in electric power tools, such as angle grinders, for example, in all small angle grinders that in future must meet the requirement for a restart protection, power drills, sanders, saws, planes or the like, but also in the case of other electrical appliances. In particular, these may be such electrical appliances that require indirectly actuated switches in combination with a locking system and/or with a restart protection.

LIST OF REFERENCES

1: (electrical) switch
2: enclosure
3: top cover (of enclosure)
4: (electrical) connection (for the mains supply voltage)
5: (electrical) connection (for the electric motor)

6: contact system
7: actuating means
8: (elastic) bellows
9: plunger
10: contact piece
11: coupling element/rotary disk/rotary pin/rotary lever
12: (movable) switching contact
13: elastic element/restoring spring/compression spring (on the contact piece)
14: gate element (on the plunger)
15: gate element (on the rotary disk)
16: actuator/electromagnet/stroke magnet/holding magnet
17: stroke rod (of electromagnet)
18: transmission element/fork element/slide
19: compression spring: (between contact piece and rotary disk)
20: restoring spring (on the electromagnet)
21: electric power tool
22: electric motor
23: actuating element
24: double arrow
25: locking element
26: swivel arrow
27: hook
28: groove
30: elastic means (on coupling element)
31: elastic element (on transmission element)/restoring spring
32: yoke (of holding magnet)
33: restoring spring (on plunger)
34: coupling region

The invention claimed is:

1. An electrical switch for an electric power tool, the electrical switch having a contact system that can be switched between an off position and an on position, a movable actuating means for switching the contact system, wherein the actuating means comprises a plunger and a contact piece, the contact piece acting on the contact system for the purpose of switching, a coupling element, and an actuator provided for moving and/or holding the coupling element such that, in a first position of the coupling element, the plunger is in interaction with the contact piece and, in a second position of the coupling element, the plunger is out of interaction with the contact piece, wherein the plunger is configured to be at least one of brought into and brought out of interaction with the contact piece such that the contact system is adapted to be switched into at least one position by means of the plunger and the contact system is adapted to be switched into the at least one position independently of the plunger.

2. The electrical switch as claimed in claim 1, wherein the contact system is adapted to be switched into the on position and the off position by means of the plunger, and the contact system is adapted to be switched into the off position independently of the plunger.

3. The electrical switch as claimed in claim 1, further comprising at least one elastic element configured to act on the actuating means for the purpose of resetting the actuating means to the off position of the contact system.

4. The electrical switch as claimed in claim 1, wherein the coupling element is disposed in a movable manner on the contact piece.

5. The electrical switch as claimed in claim 1, wherein the coupling element is held in the first position by an elastic means.

6. The electrical switch as claimed in claim 1, further comprising a transmission element, the transmission element being at least one of a slide and a fork element, provided between the coupling element and the actuator, the transmission element configured for at least one of moving and holding the coupling element, and further configured for moving the coupling element into the second position by means of an elastic element.

7. The electrical switch as claimed in claim 1, wherein the actuator is an electromagnet.

8. The electrical switch as claimed in claim 1, wherein the coupling element comprises at least one of a rotary disk, a rotary pin, and a rotary lever.

9. The electrical switch as claimed in claim 7, further comprising at least one electrical connection for supplying voltage to the contact system, the supplied voltage being received by the electromagnet.

10. The electrical switch as claimed in claim 3, wherein the elastic element comprises a compression spring configured to act on the contact piece.

11. The electrical switch as claimed in claim 4, wherein the coupling element is mounted in a rotatable manner on the contact piece.

12. The electrical switch as claimed in claim 5, wherein the elastic element comprises a compression spring.

13. The electrical switch as claimed in claim 6, wherein the elastic element comprises a compression spring.

14. The electrical switch as claimed in claim 7, wherein the electromagnet is one of a holding magnet adapted to, when receiving voltage, hold a transmission element in place, and a stroke magnet adapted to, when receiving voltage, release the transmission element.

15. The electrical switch as claimed in claim 8, further comprising a coupling region provided on one of the plunger and the coupling element, such that the coupling element can be moved into the second position when the plunger is reset out of interaction with the contact piece.

16. The electrical switch according to claim 9, further comprising an electrical connection adapted to receive the voltage switched by the contact system.

* * * * *